US010913574B1

(12) United States Patent
Winn et al.

(10) Patent No.: US 10,913,574 B1
(45) Date of Patent: Feb. 9, 2021

(54) FLAT LYING FOLDABLE INTEGRATED LID AND CONTAINER

(71) Applicant: Dublyu, LLC, Provo, UT (US)

(72) Inventors: Travis Winn, Provo, UT (US); Tyler Winn, Provo, UT (US)

(73) Assignee: Dublyu, LLC, Provo, UT (US)

( * ) Notice: Subject to any disclaimer, the term of this patent is extended or adjusted under 35 U.S.C. 154(b) by 0 days.

(21) Appl. No.: 16/031,959

(22) Filed: Jul. 10, 2018

Related U.S. Application Data

(63) Continuation of application No. 29/552,319, filed on Jan. 21, 2016, now Pat. No. Des. 836,339.

(51) Int. Cl.
*B65D 21/08* (2006.01)
*B65D 25/28* (2006.01)
*B65D 43/16* (2006.01)

(52) U.S. Cl.
CPC ..... *B65D 21/086* (2013.01); *B65D 25/2808* (2013.01); *B65D 43/162* (2013.01)

(58) Field of Classification Search
CPC ..... B65D 21/086; B65D 25/2808; B65D 43/162; B65D 5/241; B65D 5/2678; B65D 1/225; B65D 5/3678
USPC ..... 229/117.01, 117.05, 186; 220/666; D3/294
See application file for complete search history.

(56) References Cited

U.S. PATENT DOCUMENTS 2,841,306 A 7/1958 Vitoux
3,156,371 A 11/1964 Harrison
4,010,865 A 3/1977 Wilgus
4,790,714 A 12/1988 Schnapp
4,791,883 A 12/1988 Lehman
5,062,527 A * 11/1991 Westerman ..... B65D 5/3678 229/117
D415,680 S 10/1999 Sheffer
6,092,687 A * 7/2000 Hupp ..... B65D 43/162 220/666
6,116,501 A 9/2000 Hupp
6,126,065 A * 10/2000 Wee ..... B65D 5/2047 229/114
D442,081 S 5/2001 Paul
6,299,011 B1 10/2001 Rosenfeldt
6,315,151 B1 11/2001 Hupp et al.
6,325,239 B2 12/2001 Randall et al.
6,736,309 B1 * 5/2004 Westerman ..... B65D 5/2057 229/117.05
6,899,460 B2 5/2005 Turvey et al.
6,920,993 B2 7/2005 Sheng-Bin
6,923,516 B2 8/2005 Sheng-Bin
7,011,224 B2 3/2006 Sheng-Bin
7,017,776 B1 3/2006 Hupp
(Continued)

*Primary Examiner* — Christopher R Demeree
(74) *Attorney, Agent, or Firm* — Travis R. Banta; TechLaw Ventures, PLLC

(57) ABSTRACT

Disclosed herein are storage containers which protect or contain perishable goods or other materials. In one embodiment, a collapsible, flat lying container may include a base connecting to a plurality of sidewalls. The base and the plurality of sidewalls may be constructed from a rigid plastic and connected by a flexible joint. Each sidewall in the plurality of sidewalls may be connected to two other sidewalls by a flexible joint. Further, at least one of the plurality of sidewalls may be connected to a lid which is constructed from a rigid plastic by a flexible joint.

18 Claims, 23 Drawing Sheets

(56) References Cited

U.S. PATENT DOCUMENTS

| | | | | |
|---|---|---|---|---|
| 7,178,687 | B1 | 2/2007 | Manderfield, Jr. et al. | |
| D596,936 | S | 7/2009 | Bierschenk et al. | |
| 7,597,209 | B2 | 10/2009 | Rothschild et al. | |
| 7,631,799 | B2 | 12/2009 | Turvey et al. | |
| 7,654,402 | B2 | 2/2010 | Kusuma et al. | |
| 7,699,212 | B2 | 4/2010 | Turvey et al. | |
| 7,854,370 | B2 | 12/2010 | Turvey et al. | |
| 8,033,411 | B2 | 10/2011 | Turvey et al. | |
| 8,066,136 | B2 | 11/2011 | Turvey et al. | |
| 8,146,763 | B2 | 4/2012 | Turvey et al. | |
| 8,146,773 | B2 | 4/2012 | Turvey et al. | |
| 8,608,050 | B2 * | 12/2013 | Seliger | B65D 5/2009 229/117.16 |
| 2002/0070267 | A1 | 6/2002 | Okamura et al. | |
| 2004/0031842 | A1 * | 2/2004 | Westerman | B65D 5/2057 229/117.06 |
| 2004/0164132 | A1 | 8/2004 | Kuester | |
| 2005/0035125 | A1 | 2/2005 | Bae | |
| 2005/0061810 | A1 | 3/2005 | Norland | |
| 2005/0087530 | A1 | 4/2005 | Svenson | |
| 2008/0173703 | A1 * | 7/2008 | Westerman | B65D 5/3678 229/117.01 |
| 2009/0090709 | A1 | 4/2009 | Shalomoff | |
| 2012/0024941 | A1 | 2/2012 | Skinner | |

* cited by examiner 108
144
106

108
145
144
106

108
144
145
106

108
144
145
106

108
144
145
106

108
144
145
106

108
144
145
106

FLAT LYING FOLDABLE INTEGRATED LID AND CONTAINER

PRIORITY CLAIM

This application is a continuation of co-pending U.S. Design patent application Ser. No. 29/552,319 filed Jan. 21, 2016, entitled "FLAT LYING FOLDABLE CONTAINER WITH AN INTEGRATED LID," which is incorporated herein by reference in its entirety, including but not limited to those portions that specifically appear hereinafter, the incorporation by reference being made with the following exception: In the event that any portion of the above-referenced application is inconsistent with this application, this application supercedes said above-referenced application.

BACKGROUND

1. Technical Field

This disclosure relates to storage containers. More particularly, this disclosure provides a storage container which is foldable and designed to lay flat when it is itself in storage while unfolding into a storage container to contain other items in use. The storage containers disclosed herein protect perishable goods and other materials.

2. Description of the Related Art

Conventional containers that are commercially available store a wide array of materials using a container body and a detachable, separable lid. For example, with respect to storing foods, these containers help preserve and prolong the life of their perishable foods. These containers further prevent cross-contamination by sealing foods from air and other foods.

In many cases, especially recently, these containers are considered "microwave safe" which means the materials used to construct these containers do not degrade in microwave environments or otherwise contaminate food during reheating. Similarly, these containers may be "dishwasher safe" which means they may be cleaned in a dishwasher without melting or otherwise deteriorating. Thus, these containers may be reused multiple times to both store and reheat food.

Previous efforts to facilitate storage of these containers have resulted in these containers being sold in telescoping sets such that each container fits within another container until the largest container contains each other container in the set. These containers may also fit one within the other to stack and consolidate the lids and body containers to provide better order.

Unfortunately, these conventional solutions suffer from various problems. For example, lids are stored separately from a container body and may or may not be stacked in order by size. Since, in many cases, each container body is fitted with a single lid, finding the correct lid for a particular container body may be frustrating and time consuming. Or, it may be found that the correct lid for a particular container body is missing which greatly reduces the utility of the container body corresponding to the missing lid. Since the lids are detachable, separable, and stored in a location that is separate from the container bodies, lids are frequently lost necessitating replacement of a lid or requiring a user to purchase an entire new set of containers. A single missing lid can render an entire set of containers worthless which is inconvenient and ecologically unsound.

A second issue with conventional containers is the difficulty in storing the conventional containers. For example, certain containers of the set may be first shape, such as circular, while certain other containers may be a second shape, such as rectangular. It follows that the lids must also be the same shape in the various sizes of the different containers. However, containers having different shapes are not conventionally stackable in a spatially efficient manner. In other words, a stack of circular, or round, containers may require separate storage from a stack of rectangular containers. Further, the lids for these containers are also stored separately, necessitating four different stacks of components (a circular container stack, a rectangular container stack, a stack of circular lids, and a stack of rectangular lids). Such a storage configuration invariably leads to a kitchen drawer that is a chaotic unorganized mess of partially stacked and irregularly stored containers in between a random assortment of container lids which may, or may not, fit a particular container.

It is one object of this disclosure, therefore, to provide a storage container which provides an integral lid to prevent a lid associated with the storage container from being lost. It is another object of this disclosure to provide an elastomeric storage container with an integral lid that may include flexible joints which cause the elastomeric storage container to fold into a flat configuration. It is another object of this disclosure to provide a collapsible storage container which may be assembled into an upright position to store perishable and non-perishable goods.

SUMMARY

Disclosed herein is a collapsible, flat lying container may include a base connecting to a plurality of sidewalls. The base and the plurality of sidewalls may be constructed from a rigid plastic and connected by a flexible joint. Each sidewall in the plurality of sidewalls may be connected to two other sidewalls by a flexible joint. Further, at least one of the plurality of sidewalls may be connected to a lid which is constructed from a rigid plastic by a flexible joint.

In another embodiment, a container is disclosed which includes a base which is connected to a first sidewall, a second sidewall, a third sidewall, and a fourth sidewall. The base, the first sidewall, the second sidewall, the third sidewall, and the fourth sidewall are constructed from rigid plastic and connected to each other by flexible joints. The first sidewall may further be connected to the second sidewall and the third sidewall by flexible joints. The second sidewall may further be connected to the first sidewall and the fourth sidewall by flexible joints. The third sidewall may further be connected to the first sidewall and the fourth sidewall by flexible joints. The fourth sidewall may further be connected to the second sidewall and the third sidewall by flexible joints. The container may further include a lid, constructed from rigid plastic, and connected to the first sidewall by a flexible joint.

BRIEF DESCRIPTION OF THE DRAWINGS

The accompanying drawings illustrate one or more embodiments of a flat lying foldable integrated lid and container.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate that the techniques and embodiments may also be practiced in other similar devices.

Reference will now be made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may be alternatively included in another embodiment or figure regardless of whether or not those elements are shown or described in another embodiment or figure. In other words, elements in the figures may be interchangeable between various embodiments disclosed herein, whether shown or not.

Figure 1:
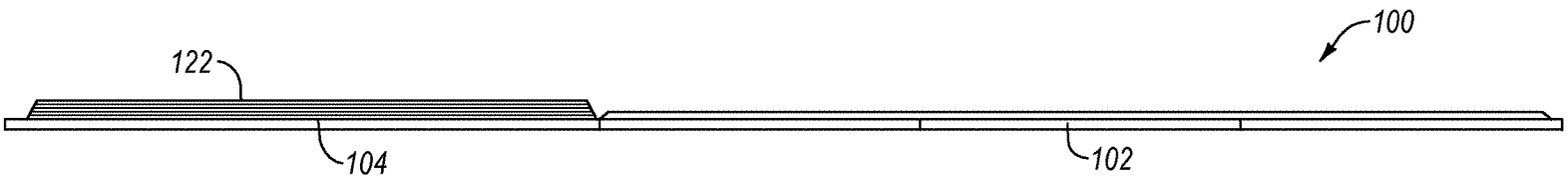
FIG. 1 illustrates a profile view of a container in a flat configuration.

FIG. 1 illustrates a profile view of a container 100 in a flat configuration. Container 100 may include an integrated attached lid 104. Container 100 may include a base 106 that becomes the bottom of the container once assembled, a plurality (e.g., four) sidewalls 108*a*-108*d* disposed around and attached to base 106 that become the sidewalls 108*a*-108*d* of container 100 once assembled, and a lid 104 attached to one of sidewalls 108*a*-108*d* and that folds over a top of container 100 when assembled, so as to cover container 100. Sidewalls 108*a*-108*d* and lid 104 are collapsible so as to be generally coplanar with base 106 when collapsed, such that container 100 in a collapsed configuration occupies very little space (e.g., being nearly 2-dimensional, exhibiting negligible height). Base 106, sidewalls 108*a*-108*d*, and lid 104 may be formed of a rigid material, such as plastic, while sidewalls 108*a*-108*d* and lid 104 may be attached to base 106 by flexible joints comprising a flexible material that exhibits increased flexibility as compared to the rigid material so as to allow selective assembly and selective collapse of container 100 with lid 104. Preferably, the flexible joints comprise an elastomeric material.

Container 100 may be implemented as a plastic food storage container that may be collapsed and folded down into a flat-lying position or may be assembled into a sealable food storage container with a cavity for storing food, for example. FIGS. 1-3D depict an exemplary form of a container 100. This form may be used to create containers of varying sizes (e.g., height, width, length) but similar structure to accommodate different storage needs. As illustrated, container 100 may include a container body 102 including a base 106 with four sidewalls 108*a*-108*d*, and a lid 104 that may be formed from several separate pieces that are joined together, e.g., through a two-shot injection molding process. The individual separate pieces comprising base 106, sidewalls 108*a*-108*d*, and lid 104 may comprise a rigid material (e.g., rigid plastic). A more flexible, preferably elastomeric material, may be employed in the flexible fold lines between the individual separate pieces.

The separate pieces forming base 106, sidewalls 108*a*-108*d*, and lid 104 may be sealed together at the respective fold seams by a flexible, preferably elastomeric material that forms a flexible joint along each fold line or seam. For example, the rigid portions of container 100 (e.g., base 106, sidewalls 108*a*-108*d*, and lid 104 may be injection molded from a first, relatively rigid plastic material, while an elastomeric material (e.g., a thermoplastic elastomer, thermoset elastomer, or other elastomeric material) may be injected as a second shot of molding material or otherwise provided so as to connect the rigid members together, providing a flexible, preferably elastomeric material therebetween along which the seams may be folded to allow selective collapse and selective assembly of the container. In another embodiment, it may be possible to form the container as a single piece of material, e.g., by forming the fold lines between adjacent rigid pieces of a relatively thin layer of the same plastic material, so that the fold lines act as a flexible joint, allowing rotation of the various attached pieces about the flexible joint fold line.

The container body 102 and lid 104 together may form a container 100 that is airtight and liquid-tight so that it will be able to contain liquids and solids without exposing them to air to prevent decay or drying of food or other materials stored therein. It will be appreciated that some embodiments (e.g., meant for storage of various other items) may not need to be airtight or liquid-tight. Such embodiments may allow for circulation of air, etc., as desired. In any case, when the container is in the open, assembled configuration, it may be self-standing, even when empty. When standing up, lid 104 can remain hinged open or it can be selectively shut. Lid 104 will typically not be detachable from body 102 of container 100, preventing separation and loss of either container body 102 or lid 104.

Illustrated container 100 includes multiple folding seams so that it can be folded completely flat for storage when not in use, and then easily unfolded and opened when needed for storage of food or other items. Each of the base 106, sidewalls 108*a*-108*d*, and lid 104 may be either square or rectangular in shape. The plurality of (e.g., four) rectangular sidewalls 108*a*-108*d* of container 100 may be equal in height. According to one embodiment, when in the folded, collapsed configuration, lid 104 does not extend further than half of the total length of the entire folded, collapsed structure 100 (see FIGS. 1-2). This may better facilitate stacking of two or more collapsed containers on top of each other in opposing orientations to create a level surface (e.g., orienting a first container with the lid 104 oriented to the left, as seen in FIG. 1, and orienting another container stacked on top of the first container with its lid oriented to the right).

Figure 2:
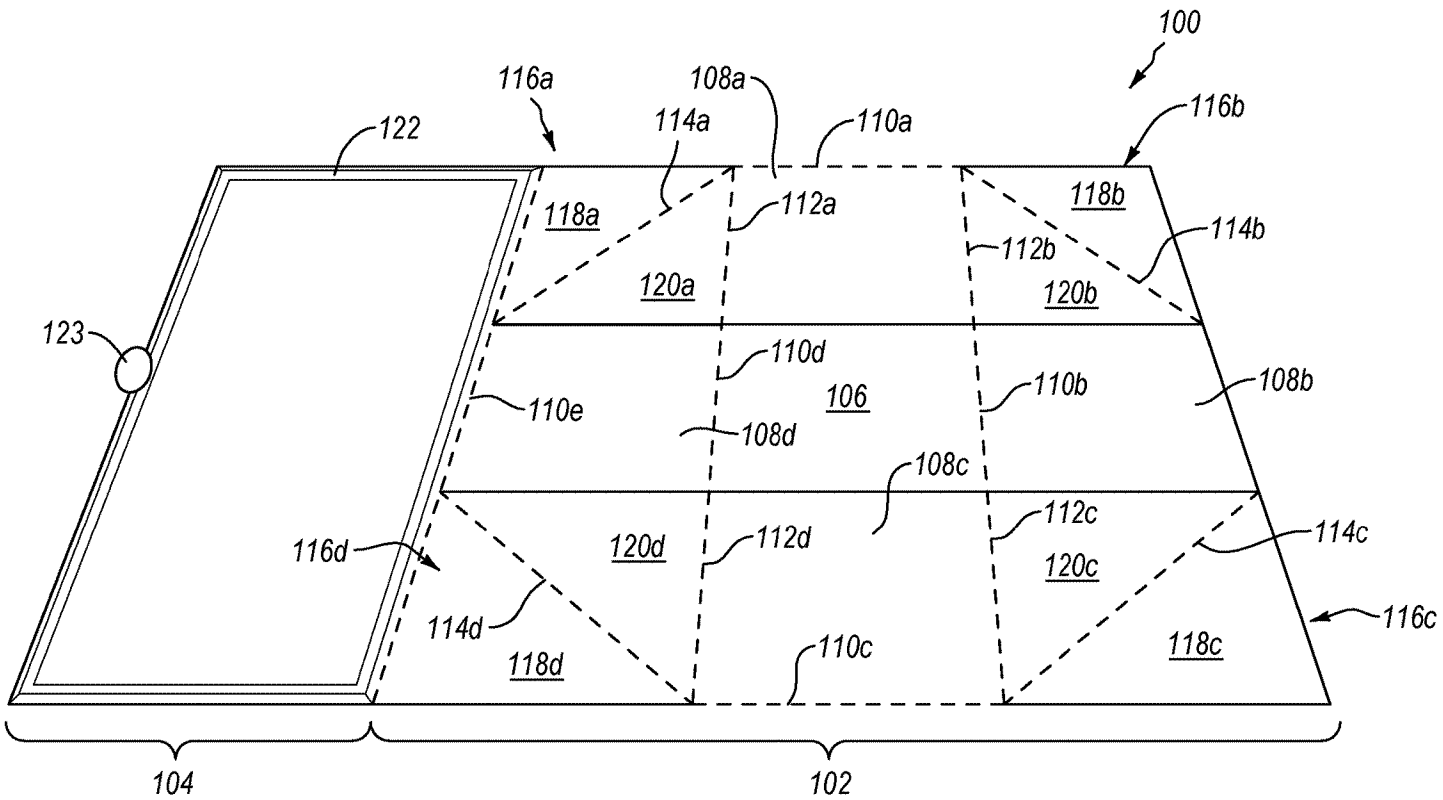
FIG. 2 illustrates a perspective view of the container shown in FIG. 1 in a collapsed configuration.
Figure 3A:
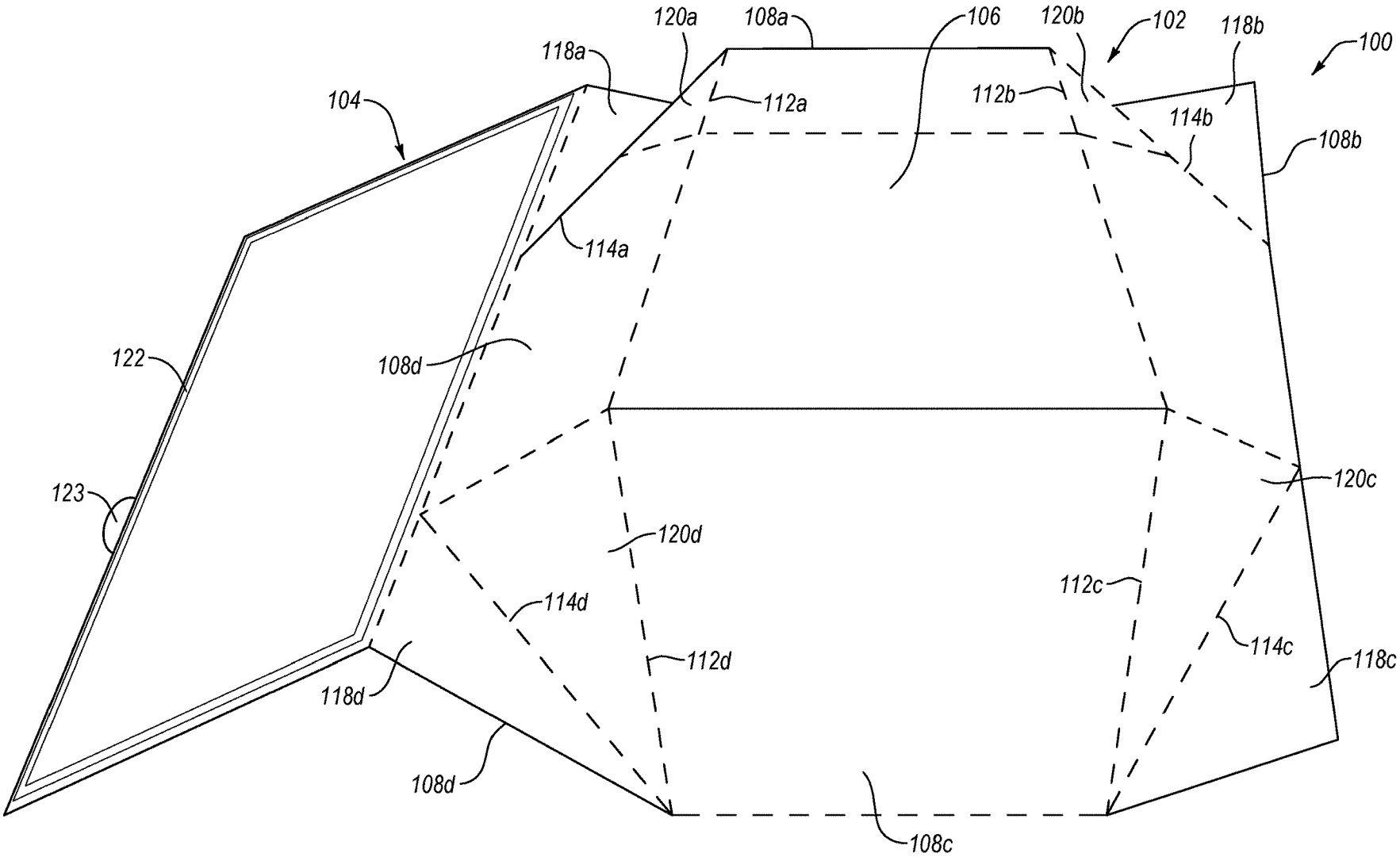
FIG. 3A illustrates a perspective view of the container shown in FIG. 1 which further illustrates rotating hinges towards a closed position during assembly.
Figure 3B:
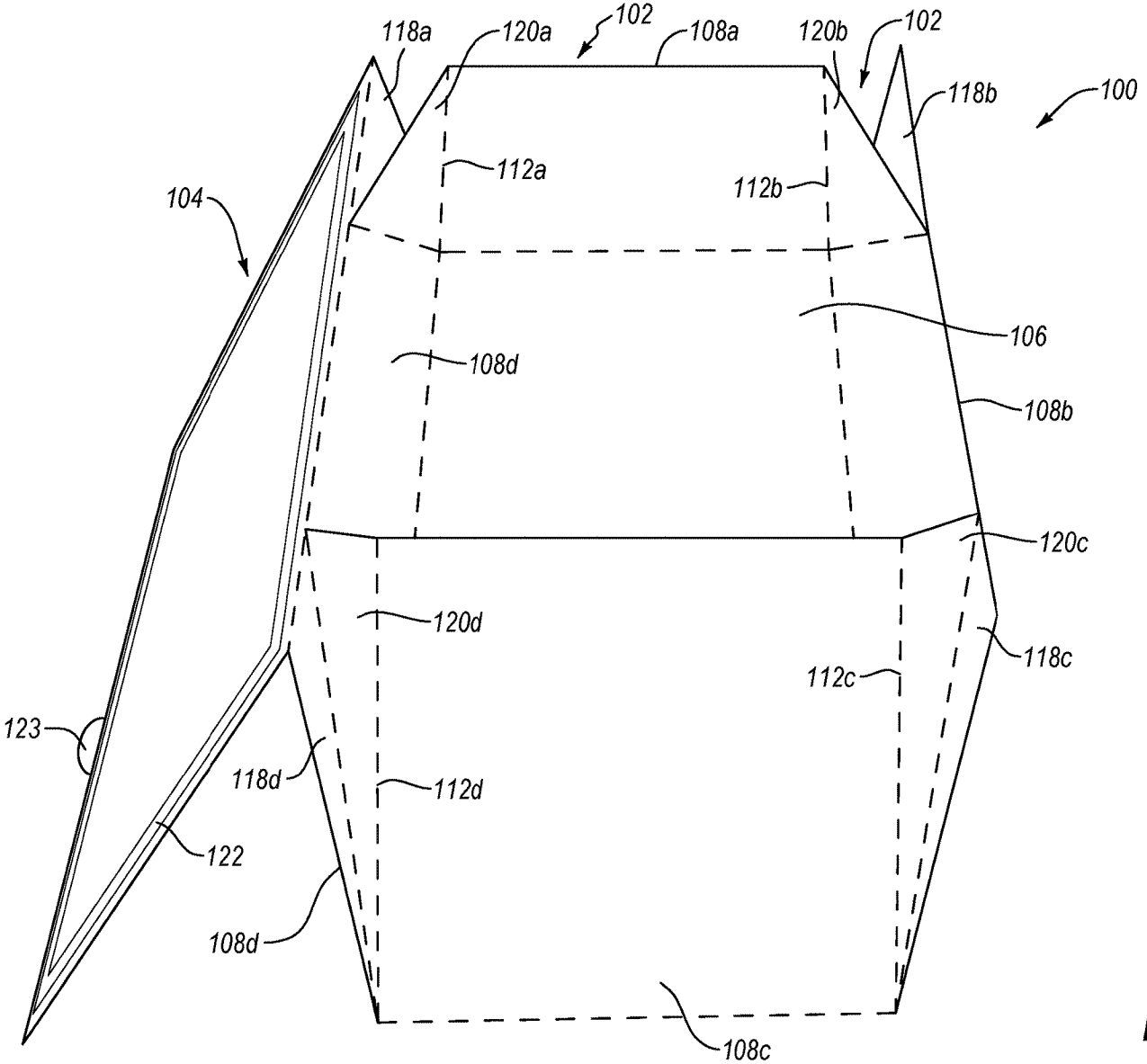
FIG. 3B illustrates the perspective view of the container shown in FIG. 3A at a second point in time where the hinges have further closed.
Figure 3C:
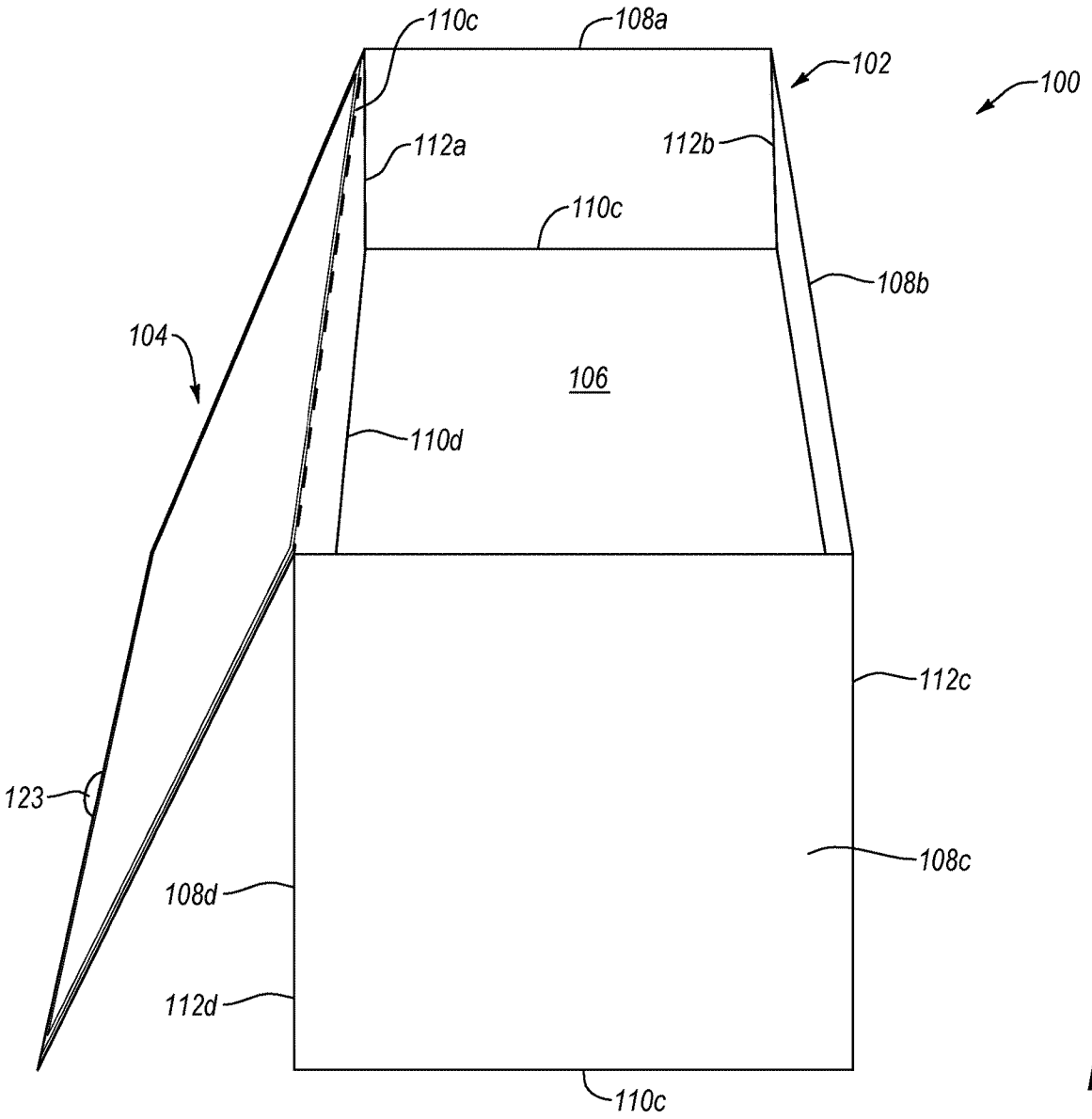
FIG. 3C illustrates a perspective view of the container shown in FIG. 3B in which the hinges have completely closed.
Figure 3D:
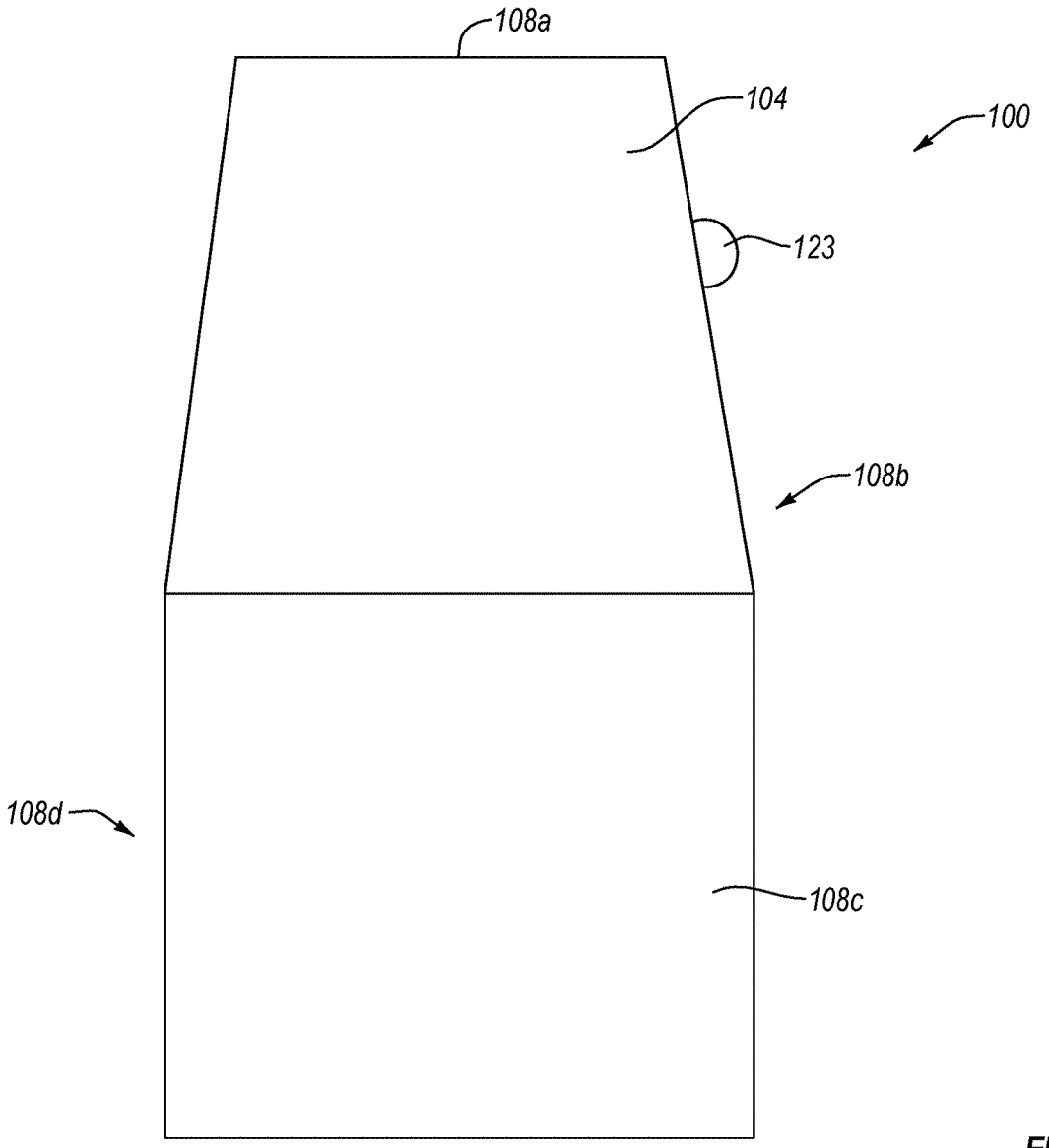
FIG. 3D illustrates a perspective view of the container shown in FIG. 3C in a closed and upright configuration.

In the embodiment of FIGS. 1-3D, four horizontal fold lines 110*a*-110*d* can be located along all four sidewalls 108*a*-108*d* of base 106 of container 100 where base 106 meets each of the four sidewalls 108*a*-108*d*. Another horizontal fold line 110*e* may be located along what becomes the top of one of the sidewalls (e.g., sidewall 108*d*), connecting it to lid 104. Four vertical fold lines 112*a*-112*d* may be located along what become opposite edges of the two opposed sidewalls 108*a* and 108*c*, once container 100 is assembled. In other words, vertical fold lines 112*a*-112*d* may be disposed at the intersection of the various sidewalls 108*a*-108*d*, once the container 100 is assembled (FIG. 3C). The term "vertical fold line" refers to the given fold line, which assumes a vertical orientation once container 100 is assembled, although it will be appreciated that when collapsed, as seen in FIG. 2, the "vertical fold lines" 112*a*-112*d* may initially lie horizontally, before being rotated up to vertical. Container base 102 further includes four 45° fold lines 114*a*-114*d* that may be located at the ends of the sidewalls 108*a*-108*d*, at the point where the each sidewall is attached to its adjacent sidewall. As the sidewalls are folded up to their vertical orientation, the 45° fold lines become part of or reside against opposed sidewalls 108*b* and 108*d*.

As seen in FIG. 2, each 45° fold line 114*a*-114*d* may be in the center of a corresponding square-shaped piece 116*a*-116*d* that is divided (e.g., diagonally bisected) into two equal-sized right triangles by its respective fold line 114*a*-114*d*. Each square 116*a*-116*d* includes an outer disposed triangle (one of 118*a*-118*d*) and an inner disposed triangle (one of 120*a*-120*d*). The faces of outer triangles 118*a*-118*d* of each of these four squares 116*a*-116*d* may be permanently fixed (e.g., fused, glued, etc.) to a respective one of the opposed ends of the two opposed walls 108*b* and 108*d*, one of which (108*d*) is touching and the other of which (108*b*) is across from lid 104. This causes outer triangles 118*a*-118*d* to not be independently movable relative to the respective sidewall to which a given outer triangle is attached. The inner disposed triangles 120*a*-120*d* of each of the four squares 116*a*-116*d* can fold or rotate in and out along the respective 45° folds 114*a*-114*d*. When container 100 is in the upright, assembled configuration, the outer and inner triangles 118*a*-118*d* and 120*a*-120*d*, respectively, will lie flat against respective sidewalls 108*b* and 108*d*, with triangles 120*a*-120*d* being sandwiched between the adjacent sidewall and the corresponding triangles 118*a*-118*d*, where corresponding triangles are aligned face-to-face with one another (e.g., triangle 120*a* is aligned with triangle 118*a*, so that the face of triangle 120*a* covers the face of triangle 118*a*). When the container is collapsed and folded flat, the entirety of each square piece 116*a*-116*d* will typically lie flat on top of the sidewalls 108*b* and 108*d*.

When container 100 is in the upright, assembled configuration (FIG. 3C), the folding triangles 120*a*-120*d* that are not permanently fixed relative to the sidewalls 108*b* and 108*d* may be secured to the other triangular half 118*a*-118*d* of squares 116*a*-116*d* by the shared hypotenuse fold lines 114*a*-114*d*. Fasteners (not shown in FIG. 2) such as magnets, snaps, suction cups, clasps, clips (male to female connection), or Velcro® (hook and loop) may be present on or within corresponding triangles to secure the sides in a vertical orientation upon assembly, to prevent the sidewalls from flopping down (e.g., under influence of gravity), back towards the collapsed configuration.

The two opposed sidewalls 108*a* and 108*c* of container 100 not touching lid 104 may typically fold inwards toward base 106 of container 100. When completely folded flat they will typically lie on top of base 106 of container 100. The two opposed sidewalls 108*b* and 108*d* of container 100, one that is touching (108*d*) and the other (108*b*) that is across from lid 104 can fold outwards, away from base 106 of container 100. When container 100 is folded completely flat, these two sidewalls 108*b* and 108*d* can be level and coplanar with base 106 of container 100. When these two sidewalls 108*b* and 108*d* are pulled outward to collapse container 100, the other two sidewalls 108*a* and 108*c* collapse inward simultaneously because they are attached to sidewalls 108*b* and 108*d* at the 45° folds 114*a*-114*d*. Because of the 45° folds attachment mechanism, any given sidewall typically cannot be folded independently of the other sidewalls.

When container 100 is folded completely flat (FIGS. 1-2), the longitudinal length dimension of container 100 may equal the width of lid 104 plus the width of base 106 plus the height of the two opposed sidewalls 108*b* and 108*d*. The folds of container 100 may all be composed of straight lines that will either be at 90° or 45° angles relative to each other. The hinged fold lines may preferably be comprised of flexible joints. As described above, such flexible joints may comprise a material having increased flexibility and elasticity as compared to the relatively rigid material from which base 106, sidewalls 108*a*-108*d*, and lid 104 are formed. In another embodiment, it may be possible to form one or more of the base, sidewalls, or lid from a single piece of plastic or other material, and provide a flexible joint structure at the fold lines by reducing the thickness of the material thereat. Such a mechanism may create points of weakness that will fold along the flexible joint fold line. Where appropriate materials are employed, the flexible joint fold lines may contribute to an overall airtight and liquid-tight seal provided by the container as a whole. That said, it may be preferred to form the flexible joint disposed between the rigid structures from a different material (e.g., an elastomer), for increased strength and durability. Various exemplary configurations for two-shot molding of (1) the more rigid structures (base, sidewalls, and lid) and (2) flexible, preferably elastomeric structures (flexible joint fold lines) disposed between the separate rigid pieces are shown and described in conjunction with FIGS. 8A-8G.

When container 100 is in the standing, assembled configuration (FIG. 3D), lid 104 may advantageously create an airtight seal to the body 102 of container 100 with a soft, pliable, elastomeric perimeter seal structure 122 that may ensure a seal between the entire inside perimeter of sidewalls 108*a*-108*d* and lid 104. A snap 123 or other securing mechanism (FIG. 2, FIG. 3D) may further serve to lock lid 104 closed over container body 102. The perimeter seal structure 122 of lid 104 can be configured to touch the body 102 of the container 100 on all four sidewalls 108*a*-108*d* on the inside of sidewalls 108*a*-108*d*, outside of sidewalls 108*a*-108*d*, top of sidewalls 108*a*-108*d*, or some combination thereof to create an airtight and liquid-tight seal along the perimeter defining the internal volume of closed container 100. In an embodiment, it may not be necessary for perimeter seal 122 to extend along sidewall 108*d*, if an adequate seal is provided by the fold line 110*e* already present between lid 104 and sidewall 108*d*. In another embodiment, perimeter seal structure 122 may extend along all four sides of lid 104, corresponding to all four sidewalls 108*a*-108*d*. The presence of a snap 123 or other securing mechanism may further aid in ensuring seal 122 of lid 104 is pressed tightly against sidewalls 108*a*-108*d*, forming an effective seal.

Figure 4A:
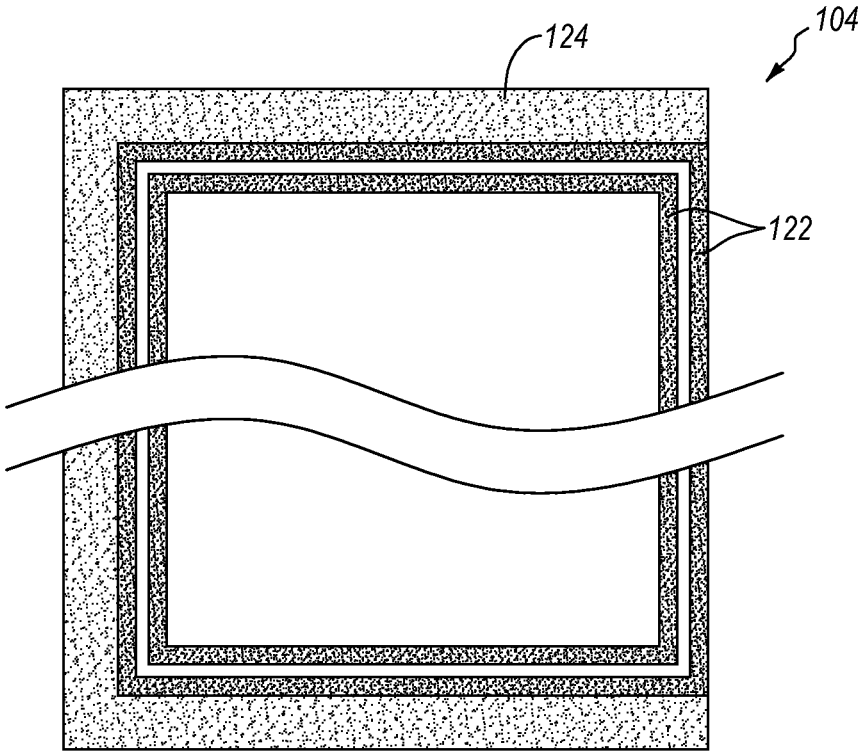
FIG. 4A illustrates a top view of a lid of a container with an inner perimeter seal.
Figure 4B:
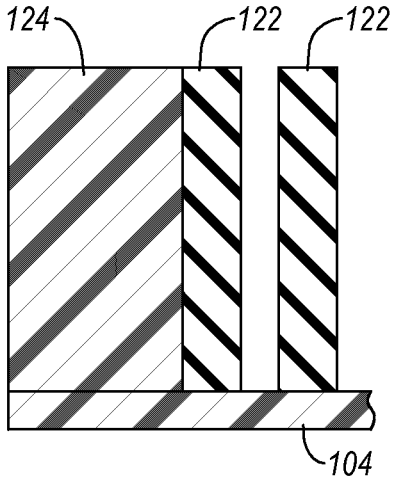
FIG. 4B illustrates a cross-sectional view through the lid shown in FIG. 4A.

The perimeter seal 122 can be pliable, flexible, and/or elastomeric so that it can absorb shock associated with dropping the container, and so that it can withstand slight pressure changes while retaining an airtight and liquid-tight seal if food or other material stored in the container expands or contracts due to temperature changes, phase changes, or compositional changes. FIGS. 4A-4B illustrate an exemplary perimeter seal 122, as well as an outer rim. Seal 122 may sandwich a given sidewall (e.g., 108*a*-108*d*) therebetween. Other sealing mechanisms are also possible. The lid 104 may further include a hard, rigid outside rim 124 (e.g., made of the same material as the lid) that runs along the outside perimeter of the lid 104 on the three sides that do not have the hinged fold line 110*e* (i.e., corresponding to sidewalls 108*a*-108*c*). Such a configuration is shown in FIGS. 4A-4B. Outer perimeter rim 124 can extend or hangover three of the outside edges of body 102 (e.g., sidewalls 108*a*-108*c*) of container 100 to prevent body 102 from expanding and to further prevent lid 104 from unintentionally coming off if container 100 is dropped. Thus, the perimeter seal 122 engages the top portion of the sidewalls (e.g., at least sidewalls 108*a*-108*c*), on the inside of lid 104, while the outer perimeter rim 124 is disposed outside of the perimeter seal 122, and may overhang and extend around the top portion of the exterior of the sidewalls 108*a*-108*c*. In an embodiment, the outside rim 124 may typically not extend any taller in height than the inner perimeter seal 122 so that when container 100 is in the folded configuration the perimeter seal 122 and outer perimeter rim 124 create a level surface for additional folded containers to rest on.

The container can be made of any desired type of material, plastics being particularly preferred for some embodiments. The plastic may preferably be hard and rigid enough to allow the container to be self-standing, but pliable enough to allow it to fold easily. When squeezed, it should allow for some movement without undue bending, creasing, cracking, or breaking. If the plastic is too pliable, the container may not be able to stand on its own. If the plastic is too thick, rigid, brittle, or unyielding, the container may be more susceptible to breakage upon dropping or upon temperature changes. The plastic can be free of harmful chemicals such as BPA, particularly when primarily used to store food. Various suitable rigid plastic and other rigid materials will be known to those of skill in the art. An exemplary material may be a copolyester, such as TRITON. Polyethylene terephthalate (PET), Polycarbonate plastic materials, polypropylene, polyethylene, and other polyolefins may also be suitable for use.

Depending on the desired characteristics of a given embodiment, various other materials such as metal, paper, cardboard (e.g., to create a portable trash receptacle or storage box for home use), Styrofoam (i.e., expanded polystyrene), etc. (e.g., to be used in food packaging) may also be employed. Disposable food containers for use in restaurant or takeout environments may employ Styrofoam, paper, cardboard, or other desired materials. Another decorative container for storage of various home or office items may be made of wood with cloth or similar binding. It will be apparent that depending on the intended use, some embodiments may be airtight and liquid-tight, while other embodiments may not include such requirements.

For reusable embodiments employed in storage of food items, the container can be microwave-safe and dishwasher-safe. For example, in order to be microwave safe, the container may be free of metal, or at least free of metal structures that may cause sparking or arcing in a microwave. Those of skill in the art will appreciate that certain metal structures, typically specifically configured smooth metal structures without sharp angles, may be employed in a microwave safely. As such, such specially configured metal structures may be included within the container. For example, specially configured magnets (e.g., encased within plastic, and without angled edges) may be provided within such a container, while still being micro-wave safe. Such magnets may serve to secure and maintain the sidewalls in their vertical orientation upon assembly, aid in locking the lid over the container body, etc. Alternatively, for microwave safety, the container may simply be free of metal. For example, instead of magnetic securing means, plastic snaps (e.g., plastic or other non-metallic cowboy shirt type snaps including a male stud and receiving female socket) or other non-metal structures may be used to secure the sides in a vertical orientation and/or to secure the lid over the container body.

The container may also be able to withstand freezing and thawing cycles without shattering, deformation, or other undesirable alteration. It can also be made of a recyclable material. The plastics or other materials used may or may not be colored. For storage of food items, the materials may be transparent or translucent so that food contained inside can be visible from the outside of the container. Of course, other container embodiments may not need to be transparent or translucent, but may be opaque, where it is not desired to view the contents of the container.

Embodiments of the present containers can also include internal dividers to separate different food or other items within a single container. Such embodiments are shown in FIGS. 5A-5D. Each of the divider walls should also be collapsible in order for the structure to fold completely flat. These divider walls may be made of a separate piece of material from the other container structures, which may be fused or otherwise attached to the base and sidewalls of the container. Such divider walls may be square or rectangular in shape, with fold lines that are at 90° and 45° angles relative to one another.

Figure 5A:
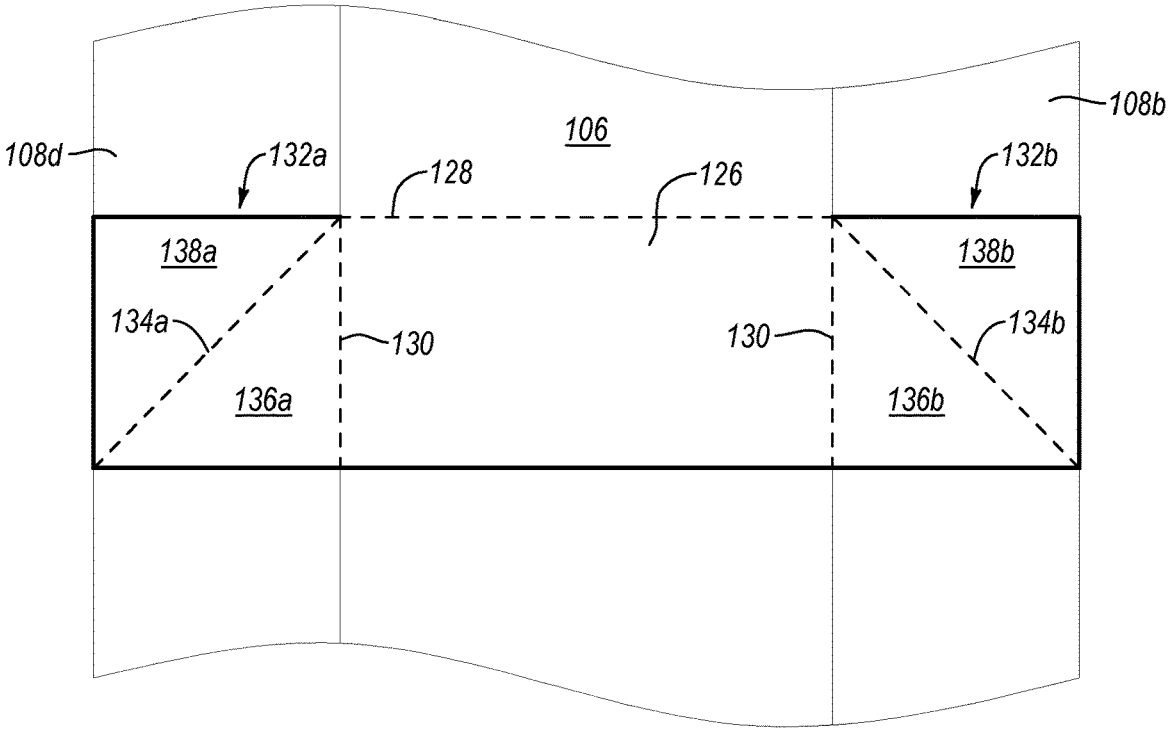
FIG. 5A illustrates top view of a collapsed container body with an integral divider wall.
Figure 5B:
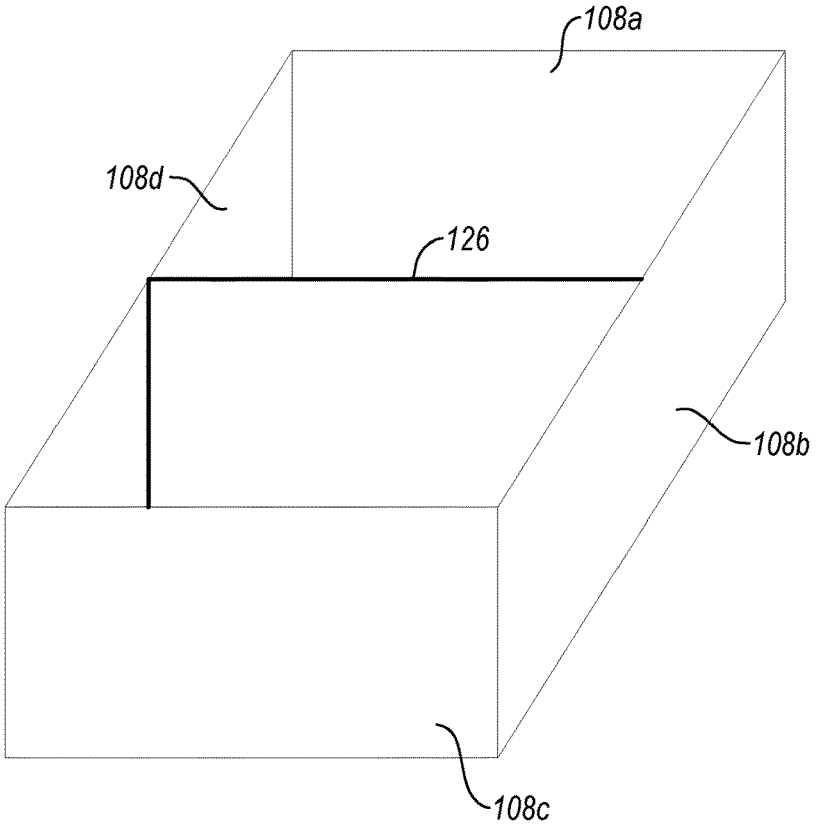
FIG. 5B illustrates a perspective view showing the container body of FIG. 5A in an assembled configuration.

FIGS. 5A-5B illustrate a divider wall 126 that is perpendicular to the sidewall 108*d* that is attached to lid 104, and which may fold up and down with its own fold lines, similar to the folding action of sidewalls 108*a* and 108*c*, to which it is parallel. Thus divider wall 126 may have a horizontal fold line 128 attaching it to the base 106 of the container 100, and vertical fold lines 130 attaching the divider wall 126 to squares of material 132*a*-132*b* (at opposite ends of wall 126) divided in half by 45° fold lines 134*a*-134*b* that attach them to the perpendicular walls 108*d* and 108*b*, respectively. Such a configuration is similar to that of sidewalls 108*a* and 108*c*. The triangular-shaped pieces 136*a*-136*b* not attached to the outside walls 108*d* and 108*b* may fasten to their corresponding triangular-shaped half 138*a*-138*b* in a similar manner as described above relative to triangles 118*a* and 120*a*. Triangles 138*a* and 138*b* may have their faces fixedly attached to a central portion of sidewalls 108*d* and 108*b*, respectively. In other words, triangles 138*a* and 138*b* (analogous to triangles 118*a*-118*d*) move with the respective sidewall (108*b* or 108*d*) to which their faces are glued or fused. Divider wall 126 may be of the same length and height as the sidewalls 108*a* and 108*c* to which it is parallel. Such divider walls may fold down simultaneously with the outside sidewalls 108*a* and 108*c* that they are parallel to. Where faces of triangles 138*a* and 138*b* are attached to sidewalls 108*d* and 108*b*, the divider wall may hinge and rotate in a rotational direction that is similar to sidewall 108*a*. It will be apparent that an opposite rotational direction can be achieved by configuring divider wall 126 analogous to sidewall 108*c*.

Figure 5C:
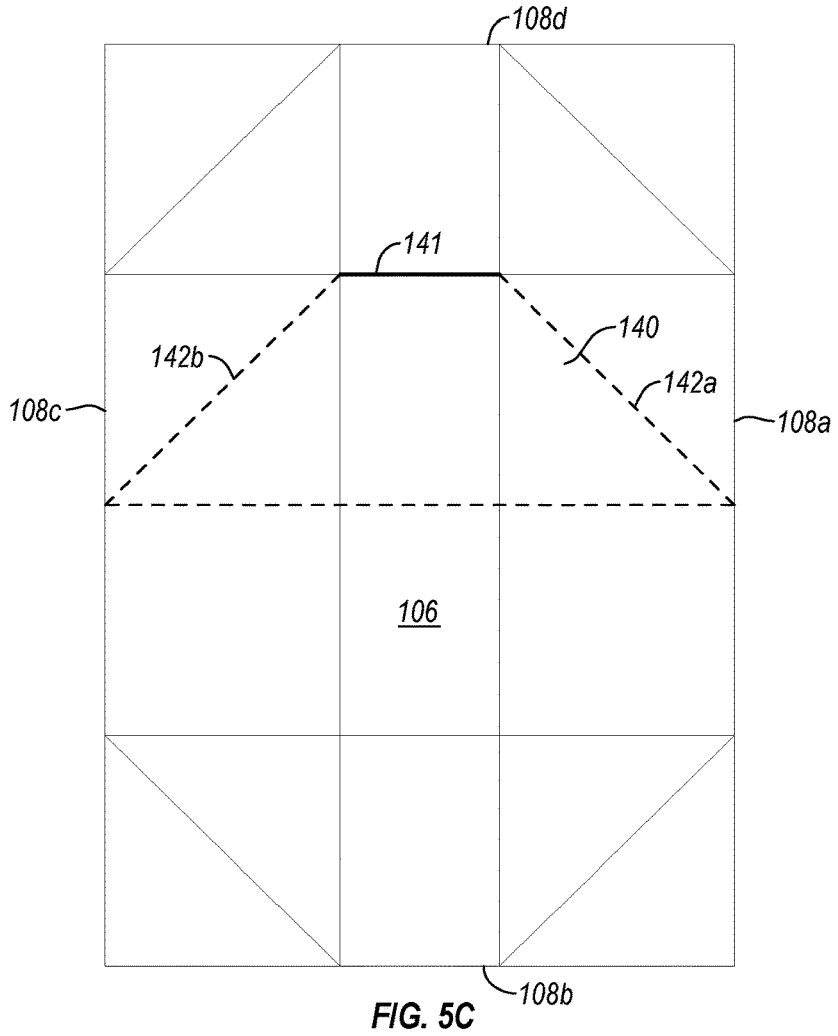
FIG. 5C illustrates a top view of another collapsed container body with another implementation of an integral divider wall.
Figure 5D:
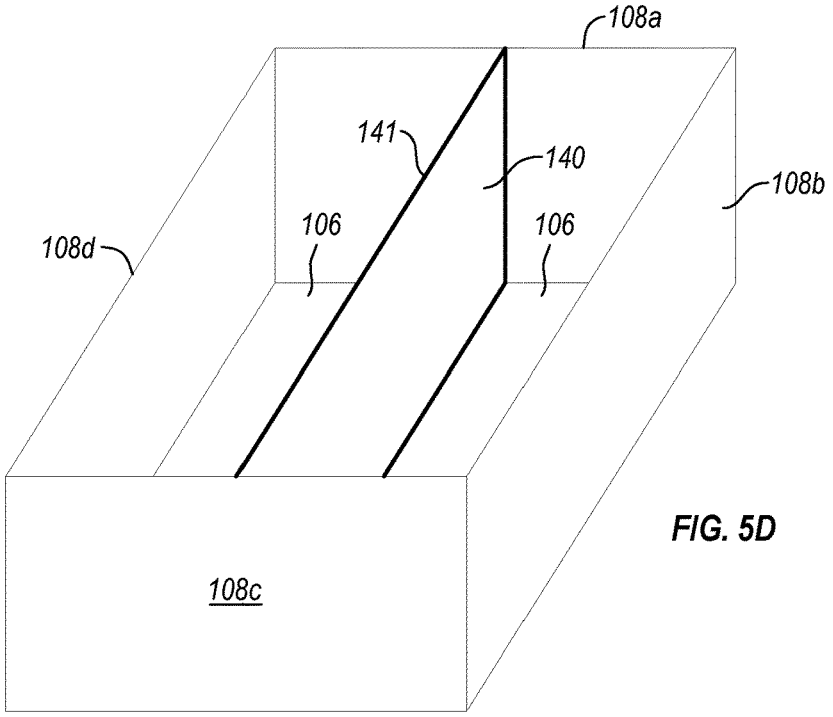
FIG. 5D illustrates a perspective view of the container body shown in FIG. 5C in an assembled configuration.

If there are one or more divider walls present that are parallel to sidewall 108*d* that is attached to lid 104, they may fold up and down in a different way, shown and described in conjunction with FIGS. 5C-5D. Divider wall 140 may be made of a separate piece of plastic or other material that is fused to the surrounding base 106 and sidewalls 108*a* and 108*c* that it touches and extends between. The folding lines or seams associated with divider wall 140 should be able to fold, but may also be airtight and liquid-tight to prevent leakage in between the divider walls within the container, if such a seal is desired. The method of folding divider wall 140 flat may include two 45° folds 142*a* and 142*b* that begin where the divider wall 140 meets sidewalls 108*a* and 108*c*, to which it is perpendicular, and the base 106 of the container 100. The fold can extend from that point up to the top 141 of divider wall 140. There will typically be a 45° fold 142*a* or 142*b* on each end of divider wall 140. When container 100 is folded flat, the sidewalls perpendicular to this wall (i.e., sidewalls 108*a* and 108*c*) can fold inward while this wall folds downward, in a similar rotational scheme as either sidewall 108*b* or 108*d*, over base 106. The two perpendicular sidewalls 108*a* and 108*c* will typically rest on top 141 of divider wall 140 while it rests on top of base 106.

If there are divider walls present within the container, perimeter seal 122 of lid 104 may advantageously include sealing portions to seal each divided portion individually while also sealing the container as a whole. Thus the soft, elastomeric, pliable inner perimeter seal 122 of lid 104 can be formed to include each square or rectangular shape that each divider forms, creating several closed sealing shapes on the lid. This sealing mechanism may advantageously touch all (e.g., four) walls of each divided portion of the container. In other words, the perimeter seal 122 may include sealing portions to seal against the top of any divider walls (e.g., wall 126 or 140). The lid may also still contain the above described hard outer perimeter rim 124 that runs around the outside of the container, outside the perimeter seal.

Figure 6A:
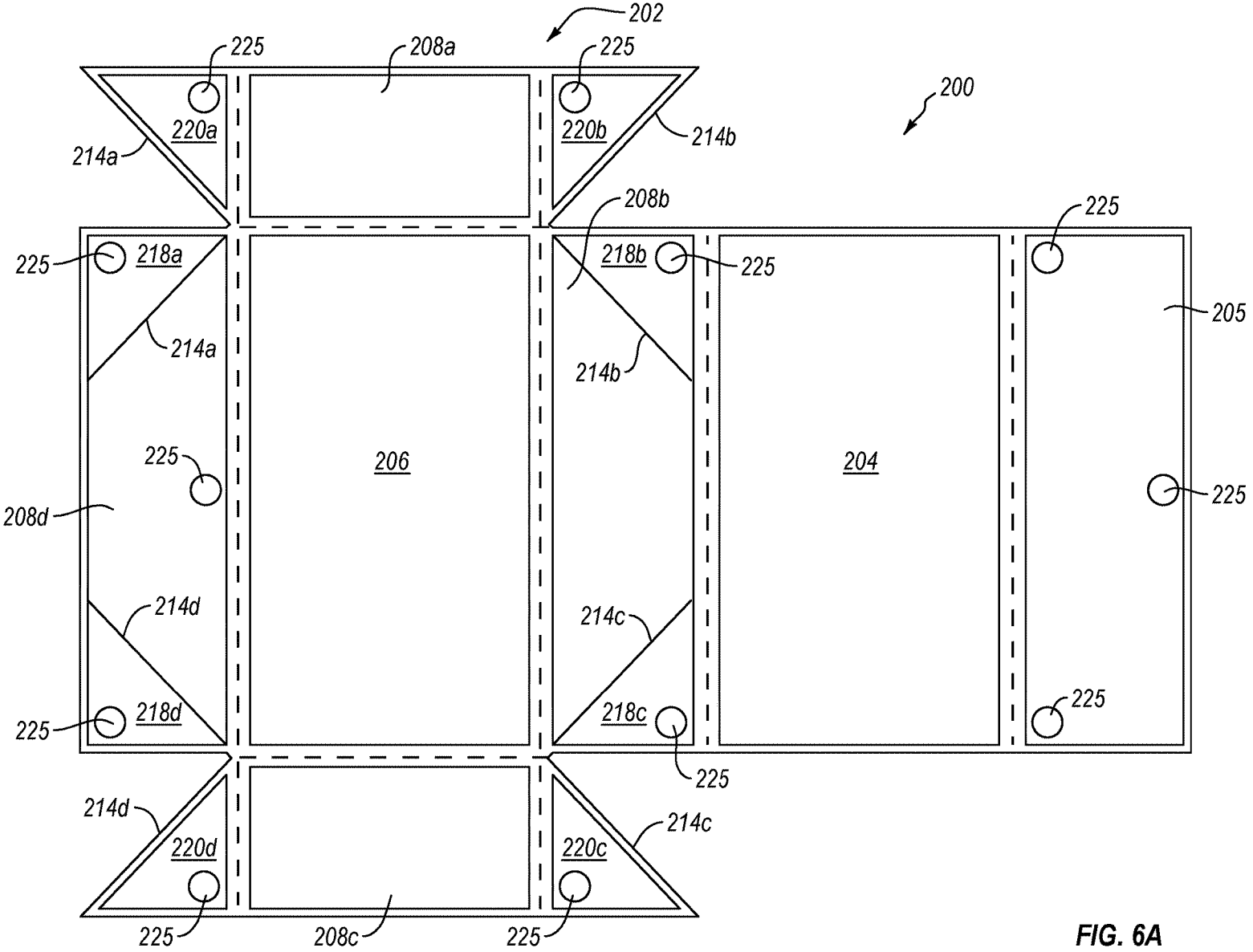
FIG. 6A is a top view of a container body in a collapsed configuration in which one or more sidewalls bend outwardly.
Figure 6B:
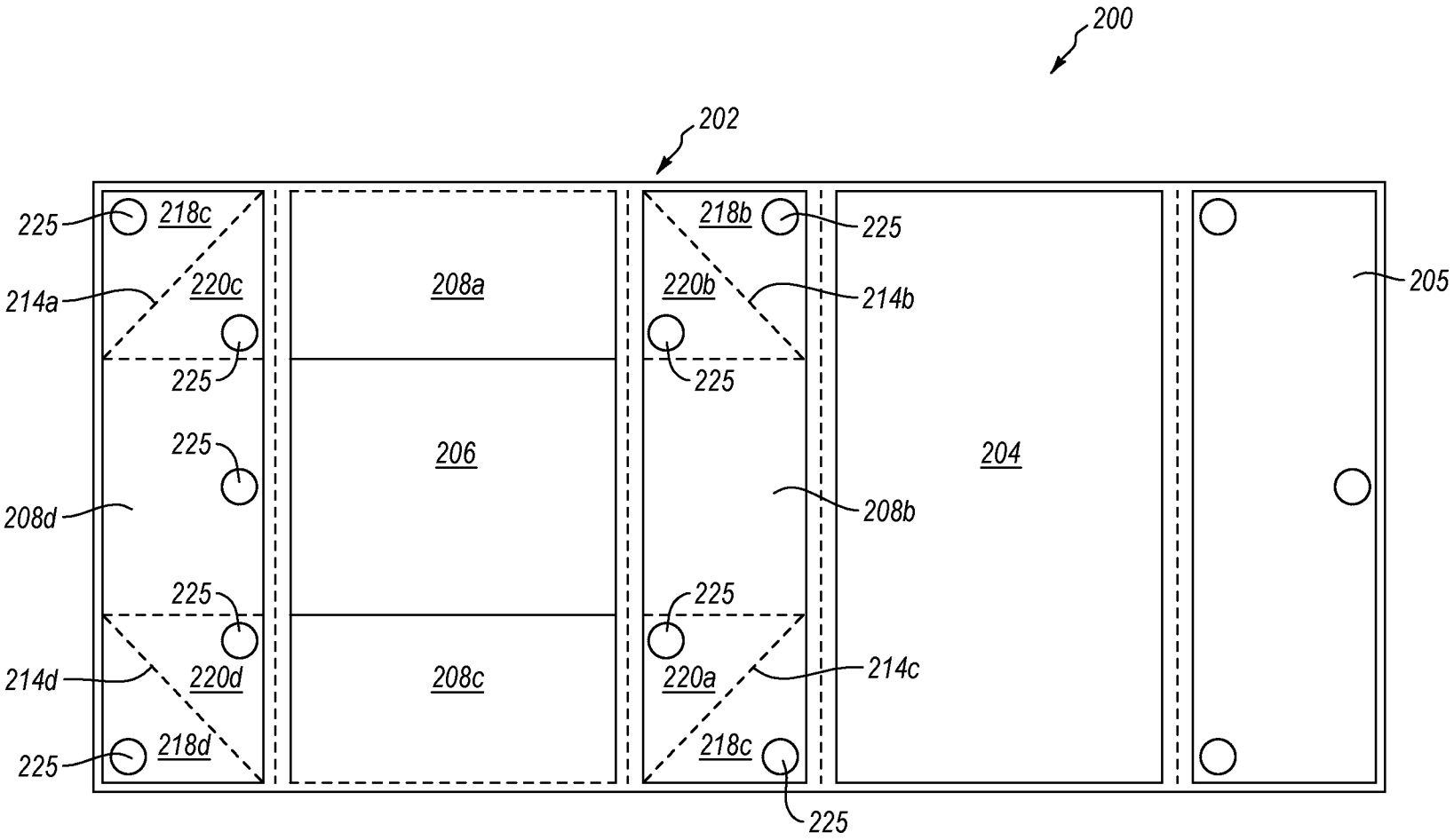
FIG. 6B is a top view of the container body shown in FIG. 6A in a collapsed configuration.
Figure 6C:
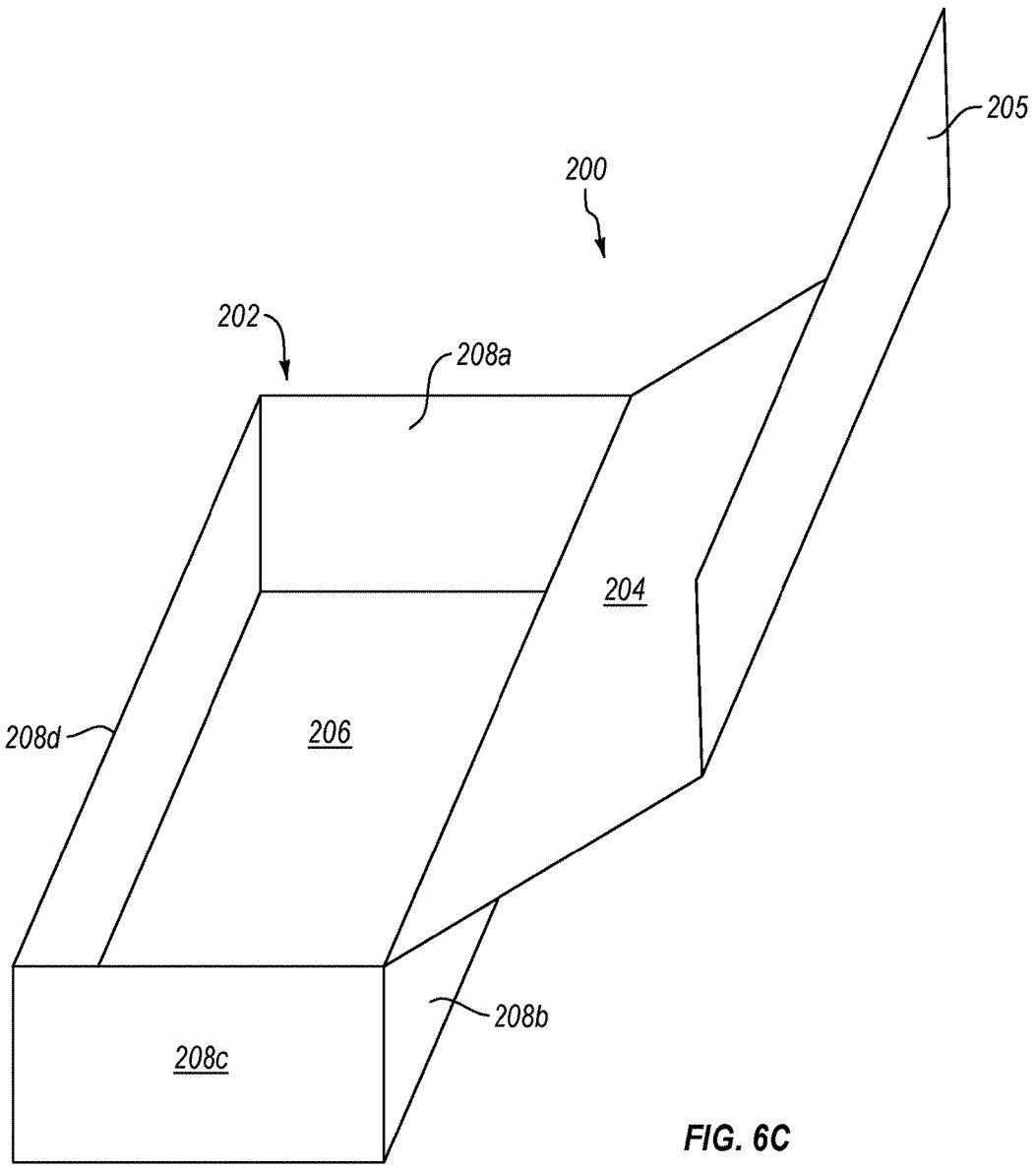
FIG. 6C illustrates a perspective view of the container shown in FIG. 6A and FIG. 6B in an assembled upright configuration with an open lid.

FIGS. 6A-6C illustrate another embodiment of a container 200 with a permanently attached, integrated lid 204. Container includes a body 202 comprising a base 206, and a plurality of sidewalls 208*a*-208*d*. FIG. 6A illustrates container 200 in a flattened configuration, showing the 45° angle hypotenuses 214*a*-214*d* of the triangles of each of sidewalls 208*a* and 208*c* before their attachment to the corresponding 45° angle hypotenuses (also labeled 214*a*-214*d*) of the triangles 218*a*-218*d* of sidewalls 208*b* and 208*d*. FIG. 6B shows container 200 once these triangles (218*a*-218*d* and 220*a*-220*d*, respectively) have been attached, hypotenuse to hypotenuse. As described above relative to container 100, the downward oriented faces of outer triangles 218*a*-218*d* may be permanently attached to corresponding sidewalls 208*b* and 208*d*, while inner triangles 220*a*-220*d* are attached to corresponding triangles 218*a*-218*d* at shared hypotenuse 214*a*-214*d*, but are otherwise free to rotate towards vertical as the sidewalls 208*a* and 208*c* are advanced to their vertical, assembled configuration. A plurality of magnets 225 or other securing means for securing the sidewalls in their vertical orientations may be provided. For example, a magnet 225 within triangle 218*a* mates with a corresponding magnet 225 within corresponding triangle 220*a*. The other triangles 218*b*-218*d* and 220*b*-220*d* may similarly include mating magnets or other securing mechanisms (e.g., snaps, Velcro, suction cups, etc.) to lock adjacent walls in their assembled configurations.

FIG. 6C shows container 200 in its assembled configuration, with lid 204 ready to be closed over container body 202 (i.e., over sidewalls 208*a*-208*d*). Container 200 is shown as further including a sidewall engaging extension 205 attached to lid 204 on an end opposite from where lid 204 is attached to sidewall 208*b*. Extension 205 may have a size and shape that corresponds to that of opposite sidewall 208*d*, so that extension 205 may be secured face-to-face thereto, providing a further securing mechanism to ensure lid 204 remains closed over container body 202. As shown in FIGS. 6A-6B, extension 205 may also include magnets 225 or other securing means for securing extension 205 to opposite sidewall 208*d* (i.e., sidewall 208*d* may include corresponding magnets 225 that mate with magnet 225 of extension 205.

Figure 7:
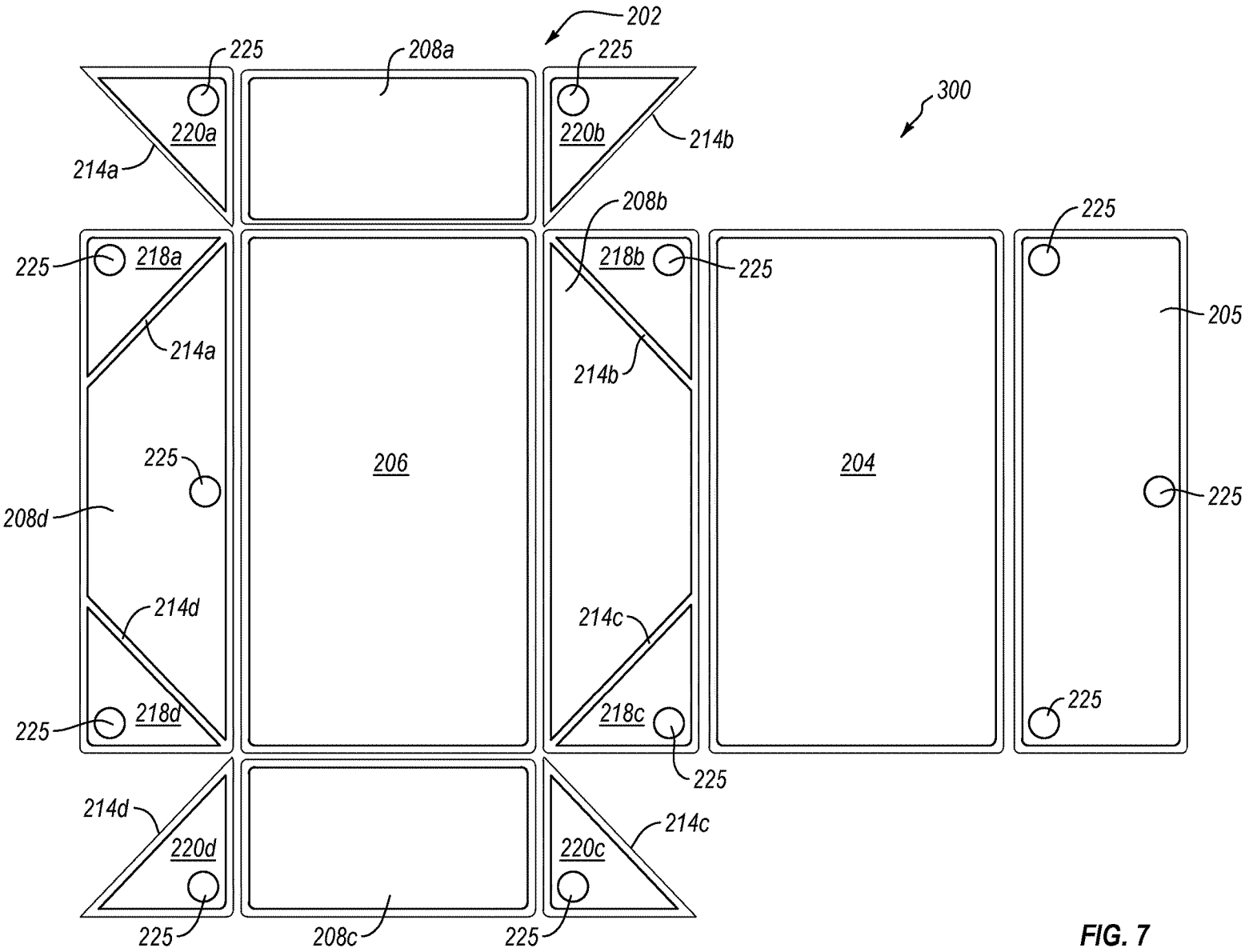
FIG. 7 illustrates a top view of another embodiment of a container body from the one shown in FIG. 6A.

FIG. 7 shows another container 300, which includes rounded corners for sidewalls 208*a*-208*d*, base 206, lid 204, and extension 205, but which is otherwise similar to container 200.

Figures 8A, 8B, 8C, 8D, 8E, 8F, 8G:
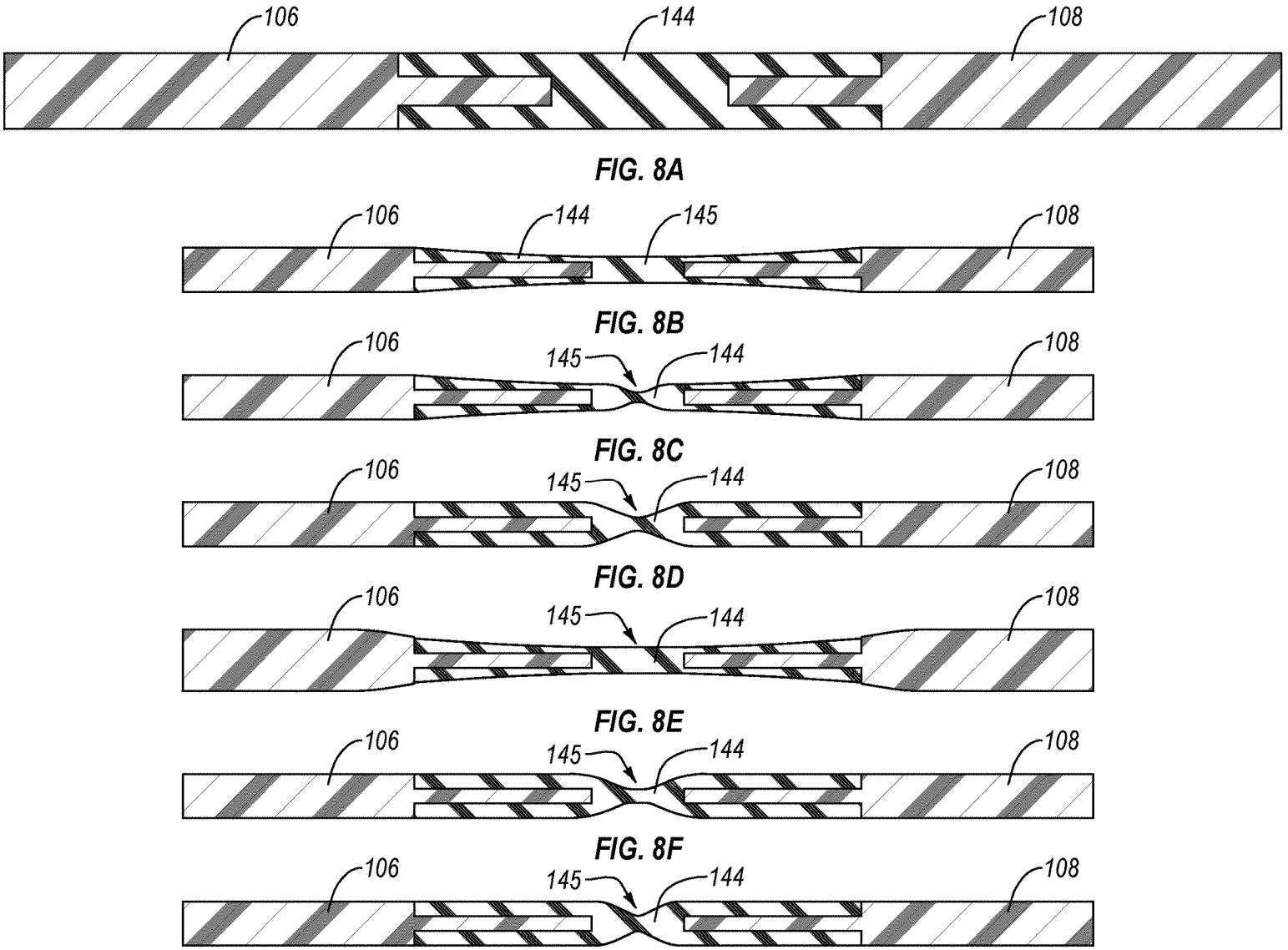
FIG. 8A-8G illustrate cross-sectional view of an exemplary container being joined together with a hinge of another material.

FIGS. 8A-8G illustrate various configurations by which the relatively more rigid members of the container (e.g., the base, sidewalls, and lid) may be attached to one another by a flexible joint comprising a relatively more flexible, preferably elastomeric material. For example, a rigid sidewall 108 may be attached to a rigid base 106 by a flexible joint 144. It will be appreciated that a sidewall 108 may be attached to a lid 104, and a lid 104 may be attached to an extension 105 by a similar flexible joint 144. Various configurations are illustrated for purposes of explanation, although it will be appreciated that other configurations are also possible. For example, FIG. 8A shows a configuration where flexible joint 144 has an outer thickness that is substantially identical to the outside thickness of adjacent rigid portions 106 and 108, so that the outside thickness across the entire structure is substantially constant, as one moves from base 106, one side of flexible joint 144 to the other, and to sidewall 108. Rigid portions 106 and 108 are shown as including a tongue, around which the elastomeric flexible joint material may be molded (e.g., as a second shot in a two-shot molding process), resulting in a configuration resembling a tongue and groove arrangement.

FIG. 8B shows the overall thickness thinning as one approaches the center (or fold line 145) associated with the flexible joint 144. FIG. 8C shows a configuration where the overall thickness may begin to taper through the cross-sectional region where both the rigid and elastomeric materials are present, and where a more drastic taper is introduced in the vicinity of the fold line 145 associated with the flexible joint 144. FIG. 8D shows a similar configuration as that of FIG. 8C, but in which the tapering only occurs in the vicinity of the fold line 145 associated with flexible joint 144. FIGS. 8E-8G show alternative, similar configurations. It will be appreciated that various configurations for attaching two rigid members (e.g., 106 and 108) together with a flexible joint may be employed.

Figure 9A:
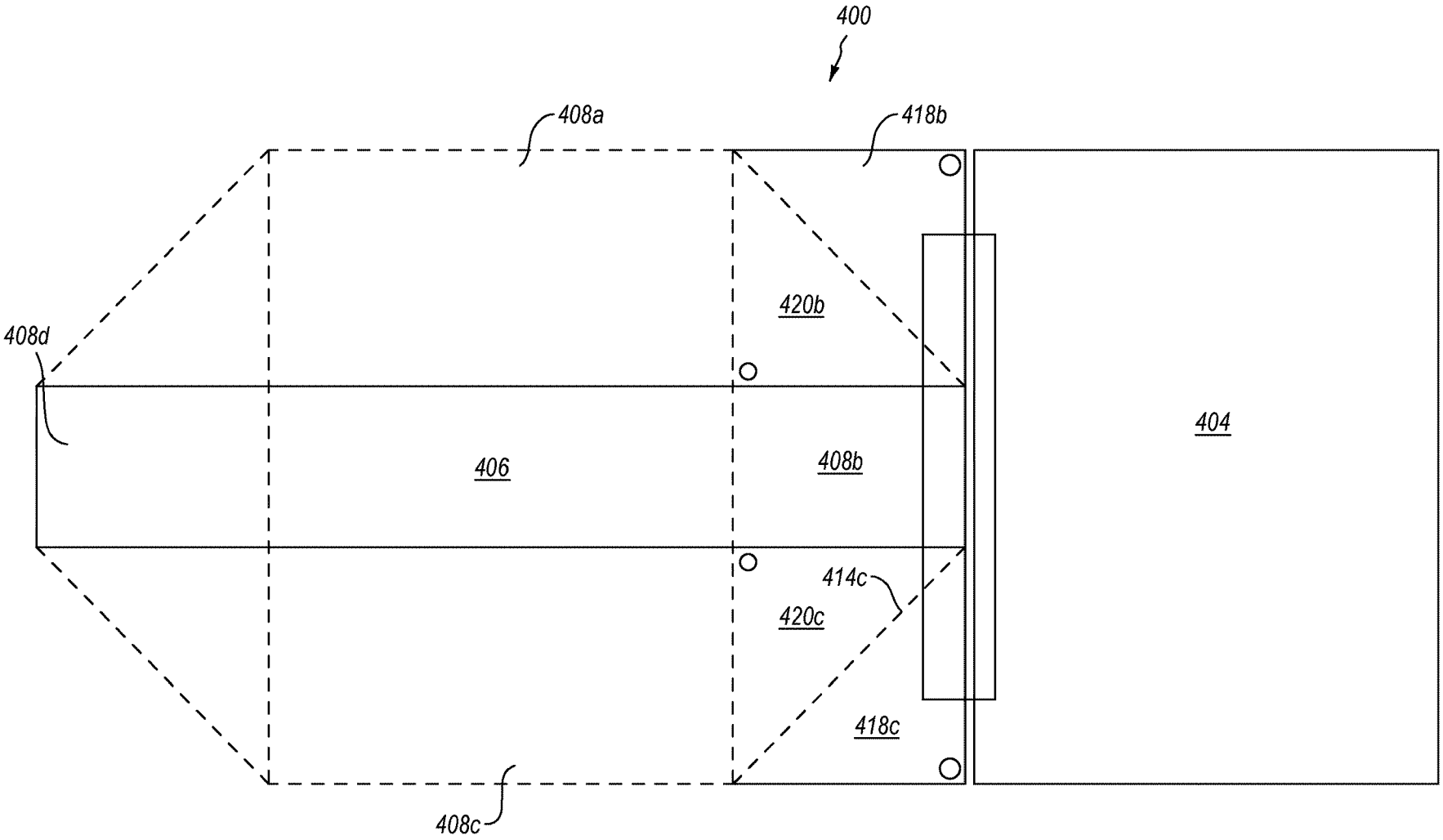
FIG. 9A illustrates a top view of a container in a collapsed configuration.
Figure 9B:
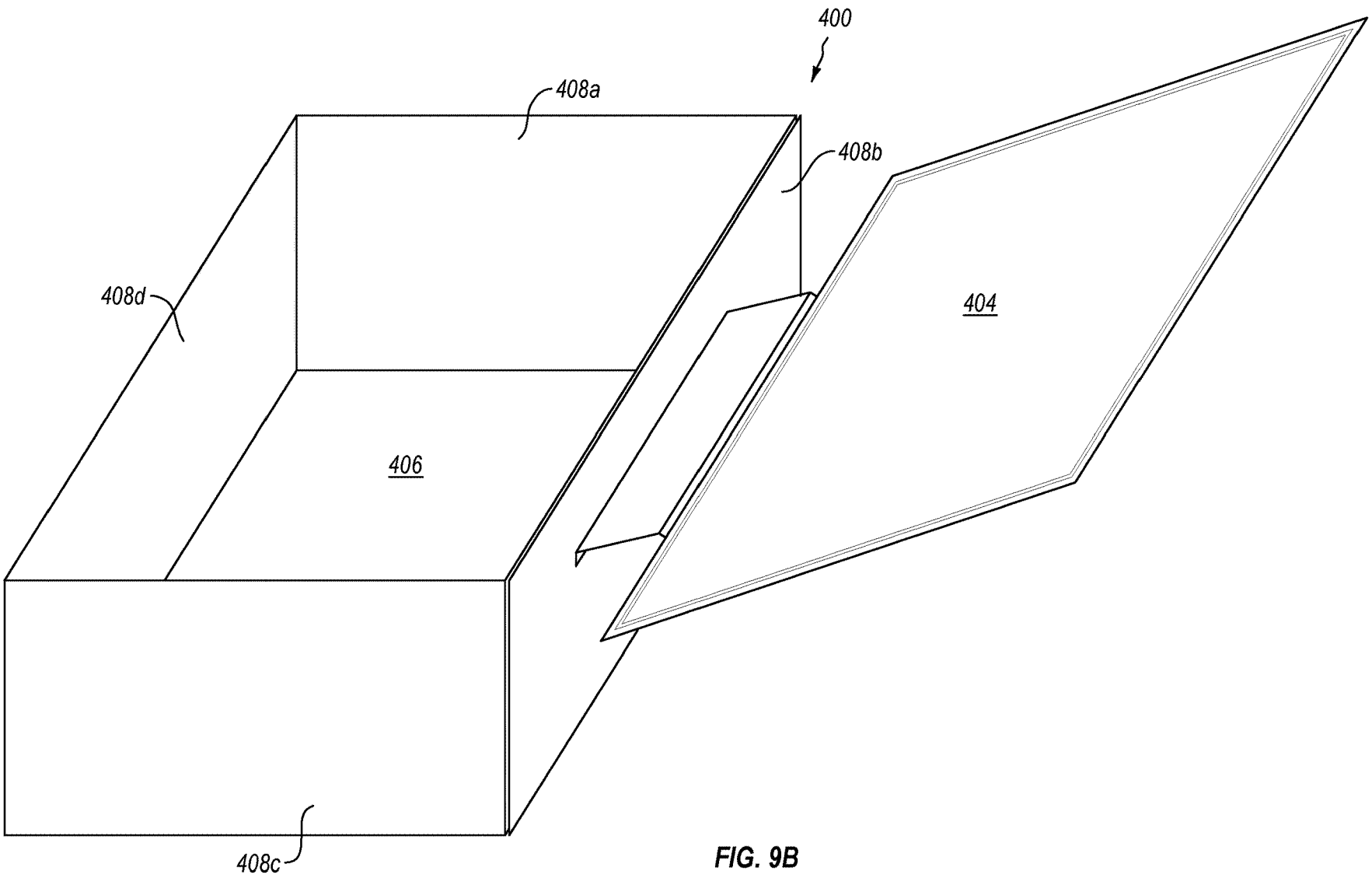
FIG. 9B illustrates a perspective view of the container shown in FIG. 9A in an assembled state with an open lid.

FIGS. 9A-9B illustrate another container 400, including base 406, sidewalls 408*a*-408*d*, and lid 404. Container 400 is similar to those described previously, although as can be seen in FIG. 9A, the collapsed sidewall 408*d* opposite lid 404 may exhibit the shape of a truncated triangle in plan view, rather than the rectangle of the embodiment of FIG. 2. For example, sidewall 408*d* may resemble sidewall 108*b* of FIG. 1, but without triangles 118*b* and 118*c*. Sidewall 408*b* of FIGS. 9A-9B may be similar to the sidewalls 108*b* and 108*d* of FIG. 1, providing plentiful width on the outside surface of sidewall 408*b* for attachment of lid 404. Sidewall 408*d* may not necessarily include a backing layer in a rectangular shape corresponding to the shape of the finished, vertical, assembled sidewall, which backing layer may aid to retain the sidewall in its vertical orientation. Rather, in the embodiment of FIGS. 9A-9B, the lid may be relied on to help maintain and secure sidewall 408*d* in its vertical orientation. FIG. 9B shows how portions of sidewall 408*b* is thus formed of two or three layers (i.e., triangles 418*b*-418*c* and 420*b*-420*c* and the sidewall 408*b* to which the lid 404 is attached, similar to sidewalls 108*b* and 108*d* of FIG. 3A-3B), while sidewall 408*d* is only of a single layer. It will be appreciated that various configurations may thus be employed.

Figure 9C:
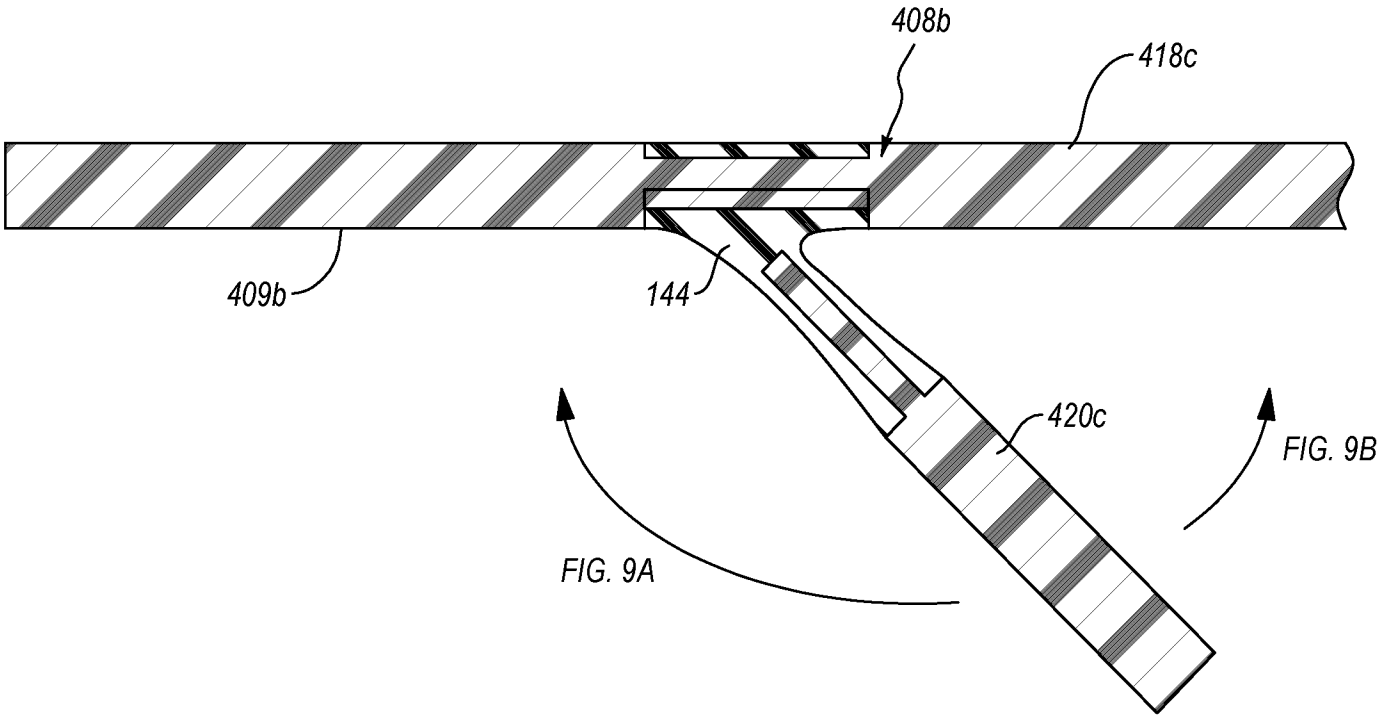
FIG. 9C illustrates a cross sectional view of a sidewall of the container.

FIG. 9C illustrates rotation of triangle 420*c* about flexible joint 144 (i.e., hypotenuse fold line 414*c*), by which triangle 420*c* is hinged to triangle 418*c* of sidewall 408*b*. As will be apparent from FIGS. 9A and 9B, triangle 420*c* is rotatable 180° about flexible joint 144. The position shown in FIG. 9C corresponds to an angle between triangle 420*c* and triangle 418*c* of sidewall 408*b* that exists as the container 400 is partially, but not fully assembled (i.e., between the collapsed configuration of FIG. 9A and the fully assembled configuration of FIG. 9B). When in the collapsed configuration of FIG. 9A, triangle 420*c* is fully rotated clockwise in the view of FIG. 9C, so as to be against the left portion of backing layer 409*b*. When in the fully assembled configuration of FIG. 9B, triangle 420*c* is fully rotated counter-clockwise in the view of FIG. 9C, so as to be against the triangle 418*c* of sidewall 408*b*.

Figure 10A:
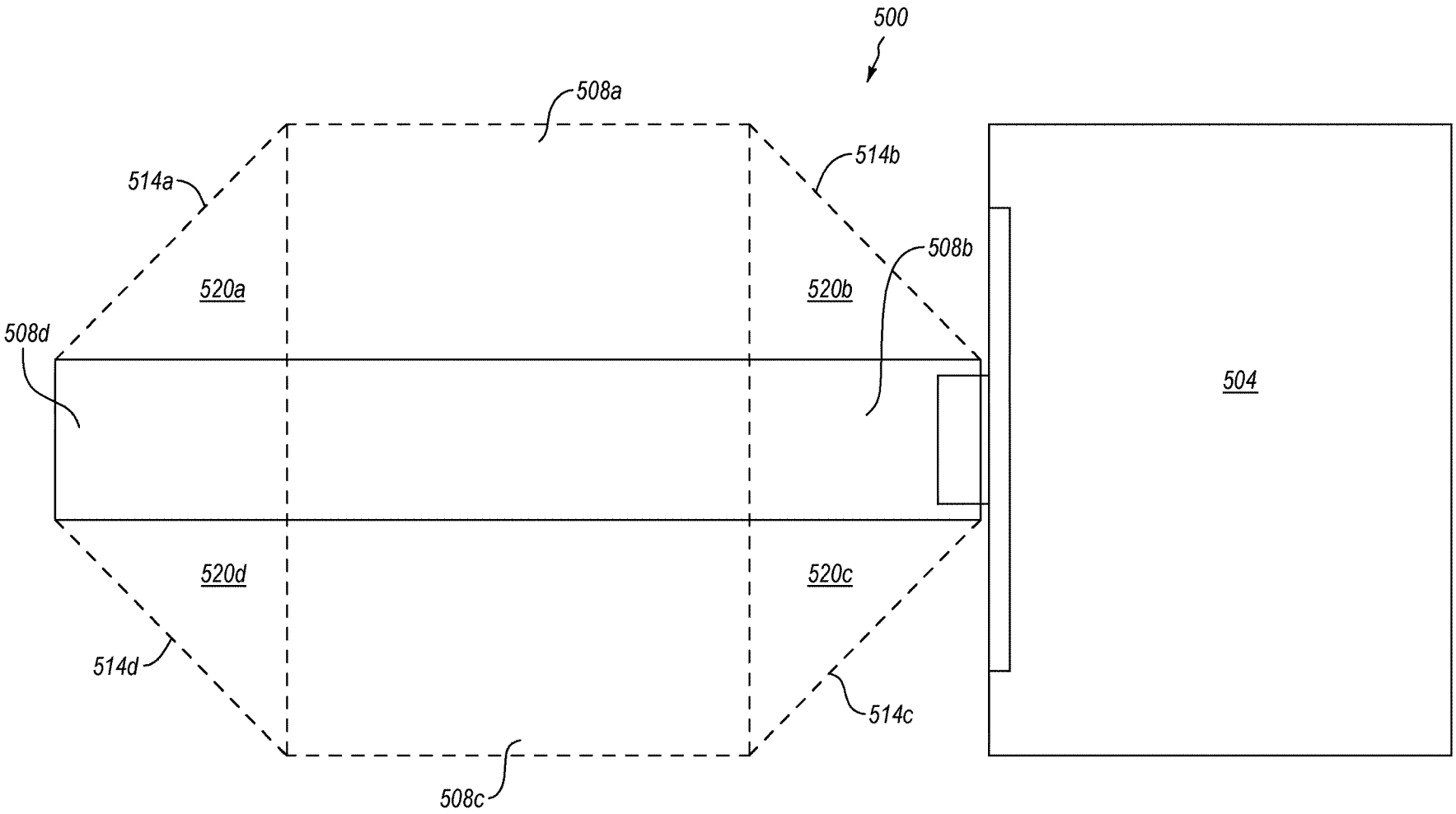
FIG. 10A illustrates a top view of a container in a collapsed configuration.
Figure 10B:
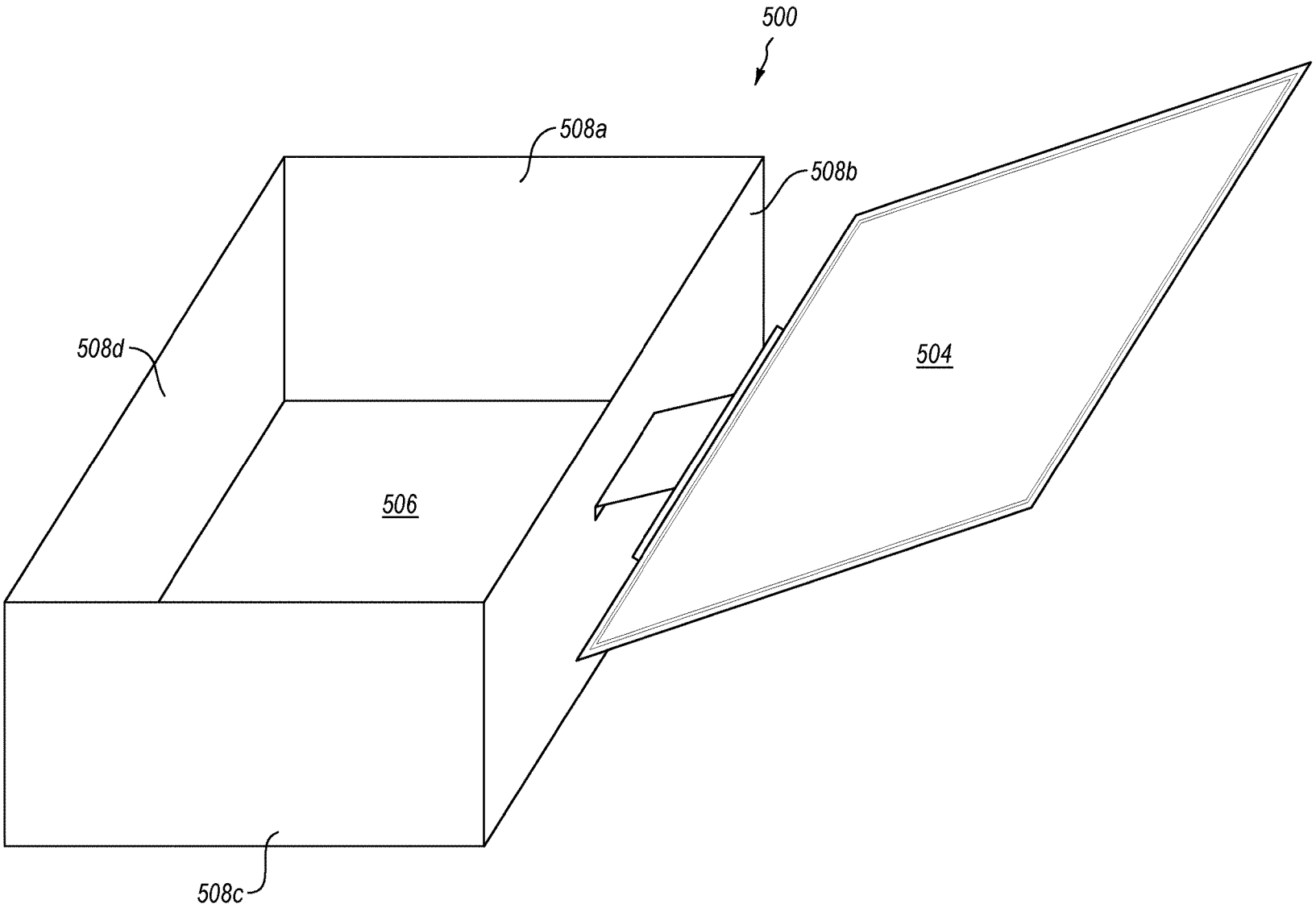
FIG. 10B illustrates a perspective view of the container shown in FIG. 10A in an assembled configuration, with the lid open.

FIGS. 10A-10B illustrate another container 500 (including base 506, sidewalls 508*a*-508*d*, and lid 504) that is similar to container 400 of FIGS. 9A-9B, but in which both sidewalls 508*b* and 508*d* are similarly configured to sidewall 408*d*, without triangles in which the face thereof is fused or otherwise attached to sidewalls 508*b* and 508*d*. Instead, only folding triangular portions 520*a*-520*d* may be provided (i.e., analogous to triangles 120*a*-120*d* of FIG. 2). Triangular portions 520*a* and 520*d* become part of sidewall 508*d*, defining the upper ends thereof once rotated to vertical. Triangular portions 520*b* and 520*c* define the upper ends of sidewall 508*b*. Lid 504 may be attached to a central portion of sidewall 508*b*, between folding triangular portions 520*b* and 520*c*. The attachment mechanism of lid 504 may not span the diagonal folding line 514*b* or 514*c* so as to not interfere with the bending of these fold lines. Alternatively, the attachment mechanism of lid 504 may span the fold line, but include a corresponding fold line itself so that the attachment mechanism can fold with fold line 514*b* and/or fold line 514*c*. Fold lines 514*a* and 514*d* (analogous to fold lines 114*a* and 114*d* of FIG. 2) may also be provided for sidewall 508*d*.

Figure 11A:
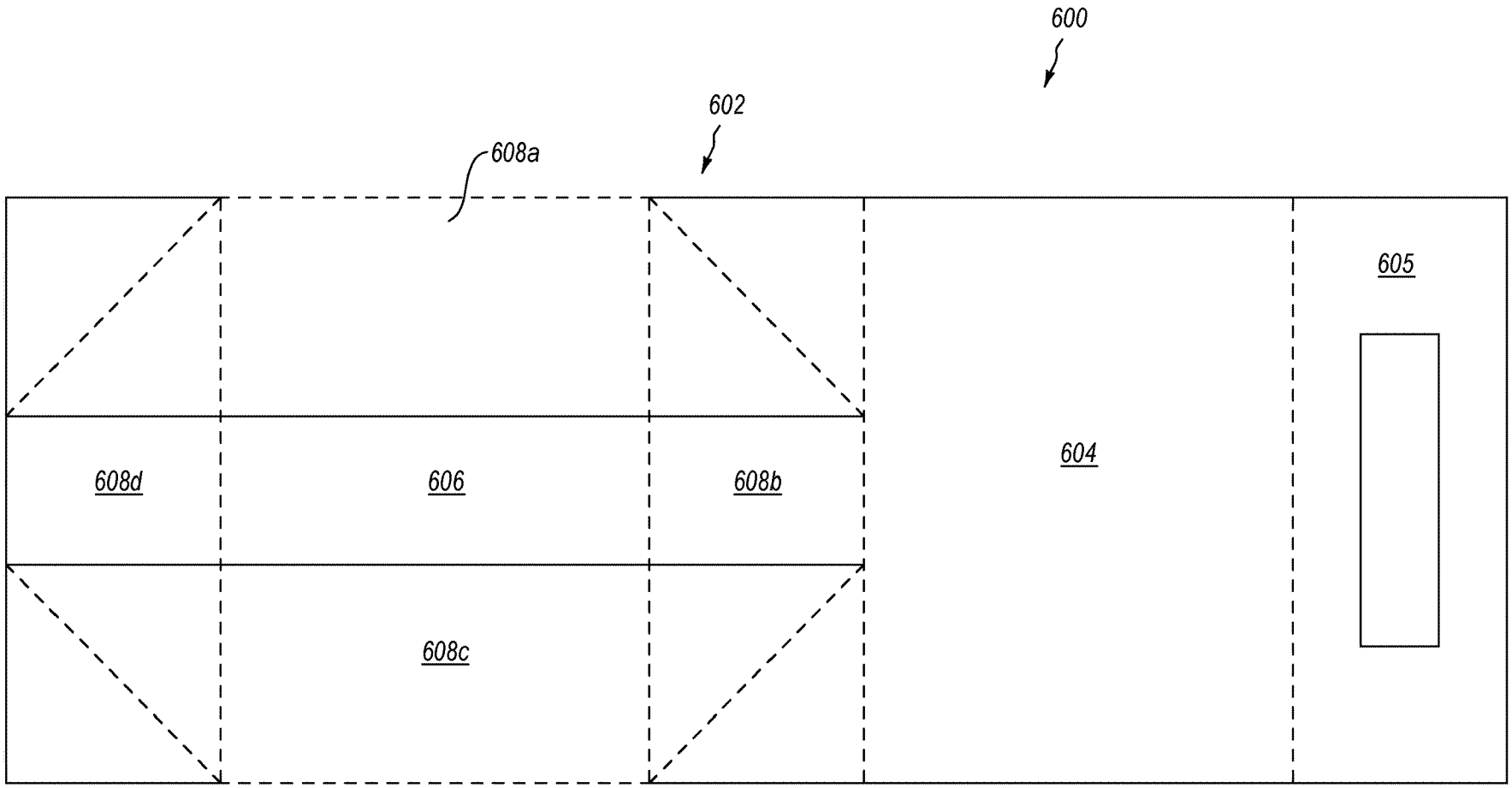
FIG. 11A illustrates a top view of a lunch box container implemented in a collapsed configuration.
Figure 11B:
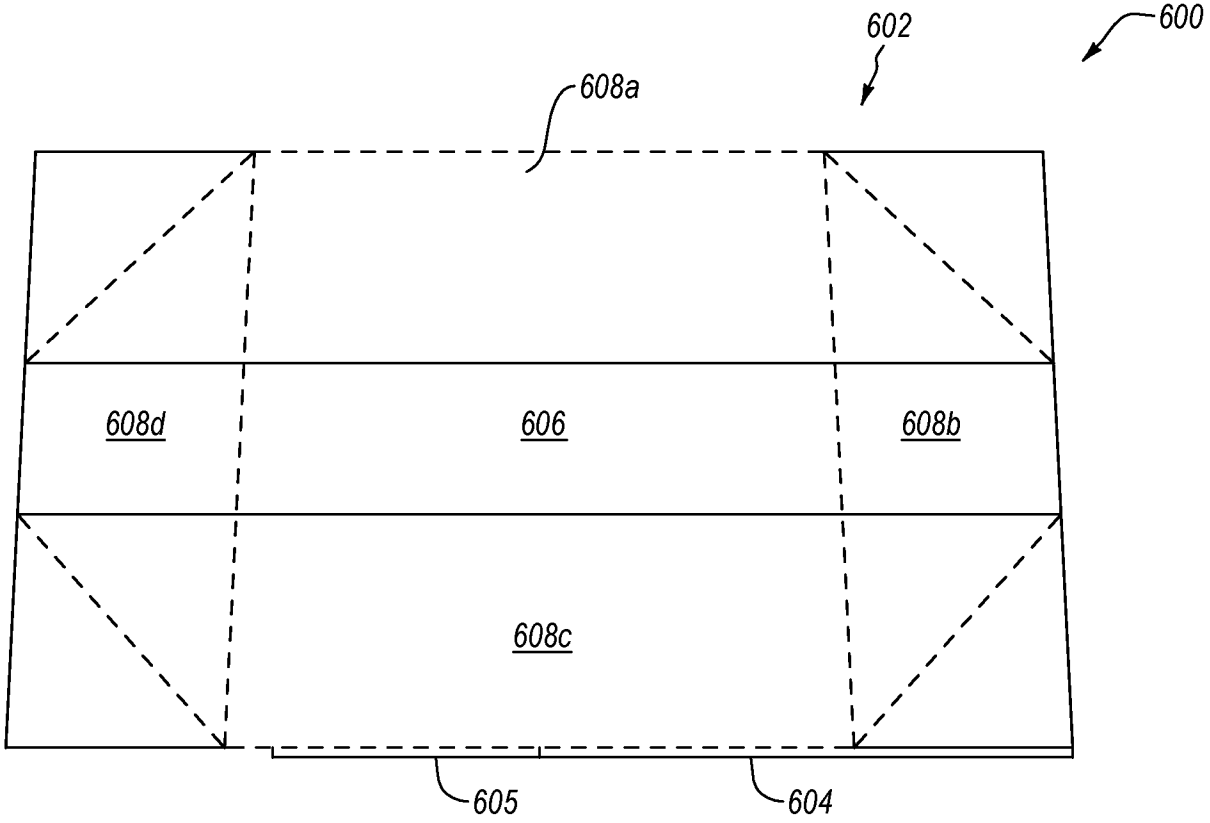
FIG. 11B illustrates a top view of the lunch box shown in FIG. 11A in which the lid has been folded under the collapsed container.

FIGS. 11A-11D illustrate a container 600 that may be configured as a collapsible lunchbox. Container 600 is similar to container 200 of FIGS. 6A-6C, including a base 606, sidewalls 608*a*-608*d*, a lid 604, and an extension 605 to lid 604, opposite the end of lid 604 to which sidewall 608*b* is attached. FIGS. 11A-11B show container 600 fully collapsed, with FIG. 11B showing lid 604 and extension 605 having been folded under body 602.

For example, lid 604 of container 600 may typically be capable of folding backwards 180° relative to sidewall 608*b*, and thereby end up underneath the body 602 of container 600 when completely collapsed, as in FIG. 11B. This can reduce the overall length of the collapsed container to be more manageable, with only negligible increase in height. This may facilitate a user placing the collapsed container into a cabinet, drawer, backpack, purse, folder, binder, or similar carrier when not in use. For example, the overall length of a collapsed lunchbox sized container as shown in FIG. 11A may be 21 inches, while folding the lid under the body (FIG. 11B) reduces overall length of the collapsed container to only 12 inches, while still having negligible height. The transverse dimension may be 8 inches in both configurations. By folding the lid and lid extension under body 602, a reduction in length of over 40% is achieved, with negligible increase in thickness. The collapsed 12 inch by 8 inch container can easily be inserted into a folder, backpack, etc., while occupying minimal space. By way of example, the sidewalls may measure 3 inches in height, and the base 6 inches in width, and 8 inches in length. It will be appreciated that any desired dimensions are possible.

Figure 11C:
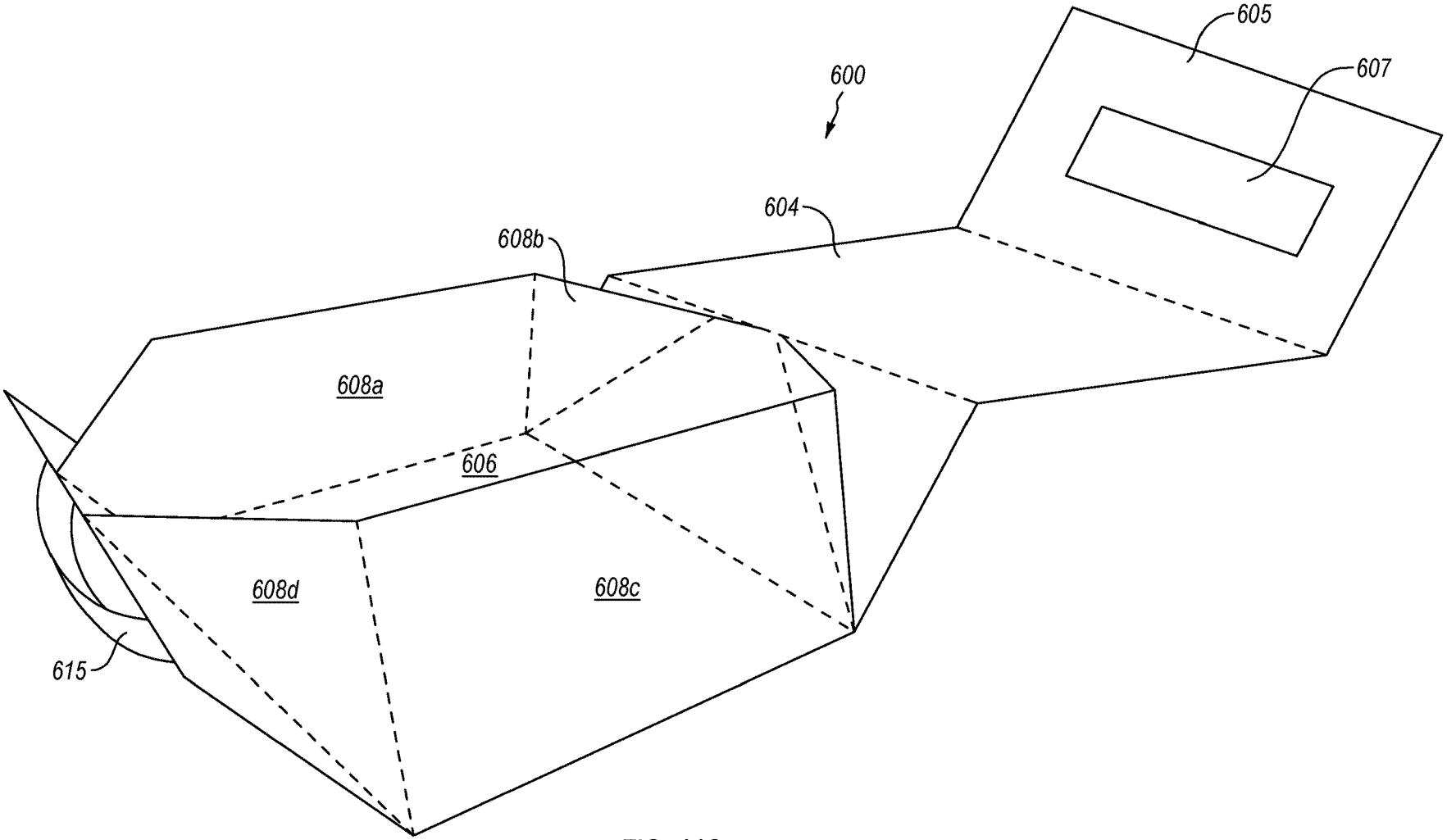
FIG. 11C illustrates a perspective view of the lunch box container shown in FIG. 11A and FIG. 11B in the process of assembly.
Figure 11D:
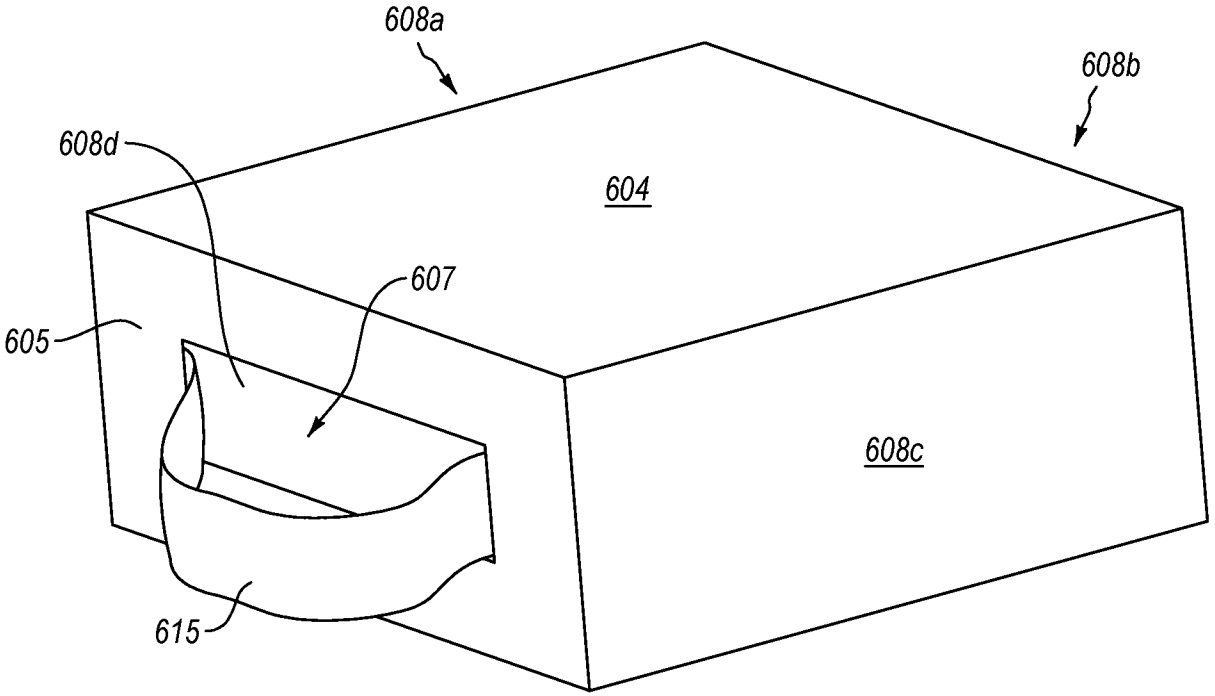
FIG. 11D illustrates a perspective view of the lunch box fully assembled.

FIG. 11C shows container 600 partially assembled, as the sidewalls 608*a*-608*d* are being rotated to vertical. As is apparent from FIGS. 6A-6C, extension 605 may include a cut-out 607 therein for receiving a handle 615 therethrough. Handle 615 may be disposed on sidewall 608*d*, opposite lid 604 and extension 605, so that upon assembly, lid closes over the top of sidewalls 608*a*-608*d*, and extension 605 closes over and mates with sidewall 608*d* so as to be parallel therewith, disposed face-to-face. Handle cut-out 607 becomes aligned with handle 615, so that handle 615 passes through cut-out 607, allowing the user to grip handle 615 to carry assembled container 600. FIG. 11D shows lunchbox container 600 in its fully assembled, closed configuration, with handle 615 extending through handle cut-out 607.

Although an embodiment of the container as described herein may be for food storage in a plastic container, various other embodiments may include but are not limited to: a hard, rigid plastic container for use in the cosmetic industry that would reduce shipping and manufacturing costs, a self-standing folding container that may or may not include an attached lid to organize desk or dresser drawers, a self-standing folding container made of various other materials such as metal, harder or softer plastics, paper or cardboard to create a portable trash receptacle or storage box for home use, a self-standing folding container made of paper, cardboard, styrofoam, etc. to be used in food packaging to be sold in stores, used by restaurants, etc., and a self-standing folding container made of wood with cloth binding for other storage purposes. In light of the present disclosure, other configurations will be apparent to those of skill in the art.

Figure 12B:
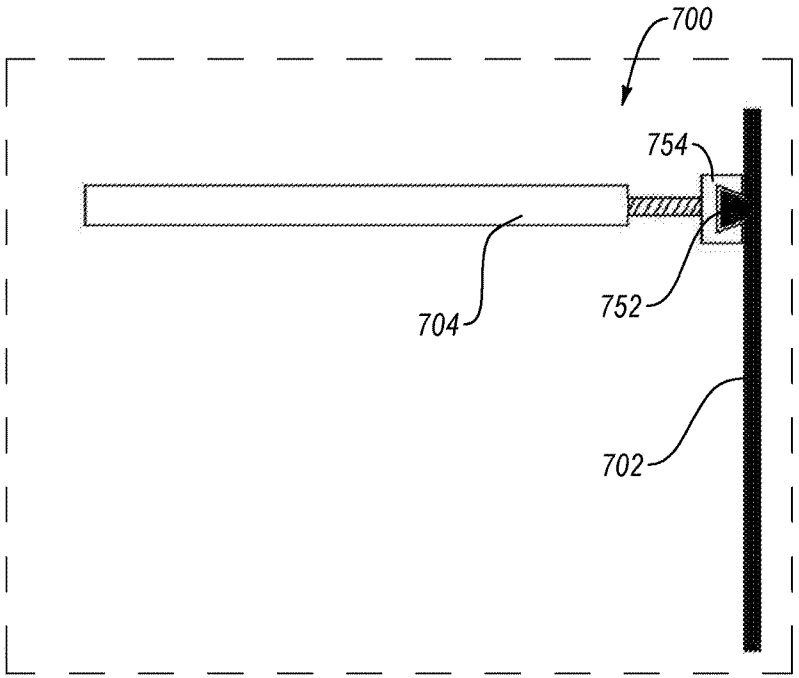
FIG. 12B illustrates a cross sectional view of an attachment mechanism for connecting a lid to the collapsible container shown in FIG. 12A.
Figure 12A:
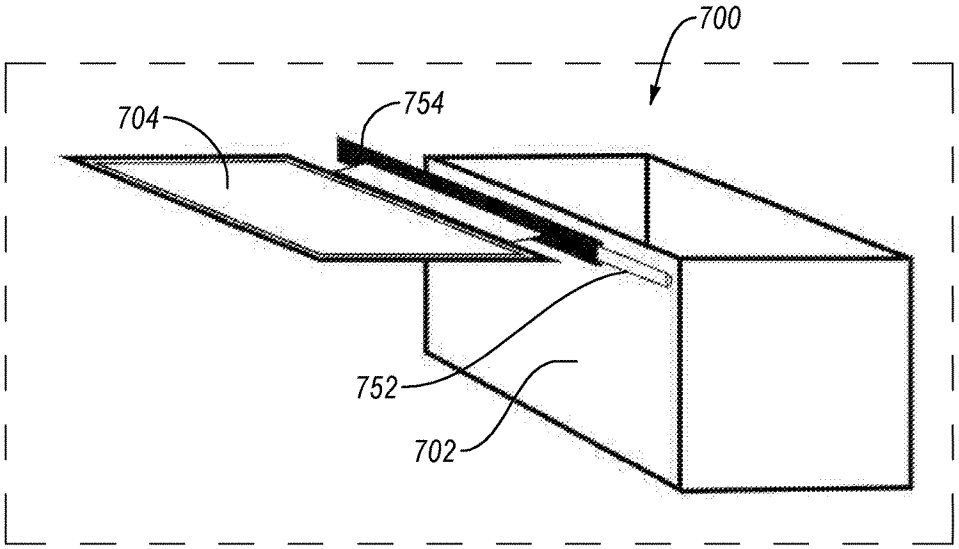
FIG. 12A illustrates a perspective view of a collapsible container and lid.

While described principally in the context of a container and lid where the lid is integral with the container body, another embodiment may include a lid which may be detachable from the container body. Such an embodiment may include any of the features described above. FIGS. 12A and 12B illustrate such an exemplary embodiment 700, which may be similar to the other embodiments described above, but in which lid 704 may be detachable from body 702. In the illustrated embodiment, a mating dovetail rail 752 and receiving sleeve 754 may be provided, one attached to or on lid 704 (e.g., sleeve 754) and the other (e.g., rail 752) attached to or on container body 702. Such a configuration may allow selective removal and separation of lid 704 from container 702, although still allowing it to be retained thereto, even though lid 704 is not closed over container body 702.

The foregoing description has been presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A container, comprising:

a base connected to a plurality of sidewalls, the base and the plurality of sidewalls being constructed from a rigid plastic and connected by a first flexible joint, wherein each sidewall in the plurality of sidewalls is connected to at least two others of the plurality of sidewalls by a second flexible joint, wherein a single one of the plurality of sidewalls is directly connected to a lid constructed from a rigid plastic by a third flexible joint, wherein the container is formed by folding from a flat configuration into a box along a plurality of flexible joints including the first flexible joint, the second flexible joint, and the third flexible joint, the plurality of flexible joints being constructed from an elastomeric plastic material, wherein a length of the lid in the flat configuration is less than half of the total length of the container, wherein the lid includes a seal attached to the lid and the lid is selectively contactable to a top of the plurality of sidewalls other than the single one of the plurality of sidewalls to which the lid is directly connected by the flexible joint, and wherein the seal attached to the lid is positioned between the lid and the top of the plurality of sidewalls when the lid is selectively contactable to the top of the plurality of sidewalls and a securing mechanism secures the lid to one of the plurality of sidewalls opposite the single one of the plurality of sidewalls.

2. The container of claim 1, further comprising:

one or more triangles connected to each one of the plurality of sidewalls by one of the plurality of flexible joints.

3. The container of claim 1, further comprising two triangles connected to each one of the plurality of sidewalls by one of the plurality of flexible joints.

4. The container of claim 3, wherein the two triangles are formed from a diagonally bisected rectangle connected to each one of the plurality of sidewalls one of the plurality of flexible joints.

5. The container of claim 4, wherein the triangles are right triangles that share a common hypotenuse.

6. The container of claim 1, wherein the container lays flat when in a collapsed configuration.

7. The container of claim 1, wherein the container is a box when in an assembled configuration.

8. The container of claim 7, wherein the lid is selectively installed to cover the box in an airtight manner.

9. The container of claim 1, wherein the lid includes a plastic seal.

10. The container of claim 9, wherein the plastic seal is positioned to contact each sidewall in the plurality of sidewalls when installed on the container.

11. The container of claim 9, wherein the plastic seal is liquid-tight.

12. The container of claim 9, wherein the plastic seal is air-tight.

13. The container of claim 1, wherein the elastomeric material is applied to the base, the plurality of sidewalls, and the lid to interconnect the rigid plastic that forms the base, the plurality of sidewalls, and the lid to form the container.

14. The container of claim 1, further comprising a divider disposed in a cavity between the base and the plurality of sidewalls.

15. The container of claim 1, wherein the lid is a single piece lid which is sized to cover each of the plurality of sidewalls when the container is closed.

16. A container, comprising:

a base connected to a first sidewall, a second sidewall, a third sidewall, and a fourth sidewall, the base and the first sidewall, the second sidewall, the third sidewall, and the fourth sidewall being constructed from a rigid plastic, wherein the base is connected to the first sidewall, the second sidewall, the third sidewall, and the fourth sidewall by a plurality of flexible joints, wherein the first sidewall is connected to the second sidewall and the third sidewall by the plurality of flexible joints, wherein the second sidewall is connected to the first sidewall and the fourth sidewall by the plurality of flexible joints, wherein the third sidewall is connected to the first sidewall and the fourth sidewall by the plurality of flexible joints, wherein the fourth sidewall is connected to the second sidewall and the third sidewall by the plurality of flexible joints, wherein the container is formed by folding from a flat configuration into a box the plurality of flexible joints which are constructed from an elastomeric plastic material, a lid constructed from a rigid plastic and directly connected only to the first sidewall by a flexible joint among the plurality of flexible joints, the lid including a seal attached to the lid, wherein the seal attached to the lid selectively contacts a top of the second sidewall, the third sidewall, and the fourth sidewall and is securable in contact with the top of the second side wall, the third sidewall, and the fourth sidewall by a securing mechanism which secures the lid to one of the first sidewall, the second sidewall, the third sidewall, and the fourth sidewall, and wherein a length of the lid in the flat configuration is less than half of the total length of the container.

17. The container of claim 16, wherein the flexible joints allow the container to be collapsibly stowed by folding the container into the flat configuration.

18. The container of claim 16, wherein box is self-standing.

* * * * *